US009004845B2

(12) United States Patent
Bernier

(10) Patent No.: US 9,004,845 B2
(45) Date of Patent: Apr. 14, 2015

(54) INVERTING OF ATTACHMENTS FOR WORKING MACHINES HAVING FRONT END LOADER CONFIGURATIONS

(76) Inventor: Gilbert Bernier, Winnipeg (CA)

( * ) Notice: Subject to any disclaimer, the term of this patent is extended or adjusted under 35 U.S.C. 154(b) by 304 days.

(21) Appl. No.: 13/591,307

(22) Filed: Aug. 22, 2012

(65) Prior Publication Data

US 2013/0051964 A1 Feb. 28, 2013

Related U.S. Application Data

(60) Provisional application No. 61/527,875, filed on Aug. 26, 2011.

(51) Int. Cl.

| | |
|---|---|
| ***E02F 3/00*** | (2006.01) |
| ***E02F 3/36*** | (2006.01) |
| ***E02F 3/32*** | (2006.01) |
| ***E02F 3/30*** | (2006.01) |
| ***E02F 3/96*** | (2006.01) |

(52) U.S. Cl.

CPC ..... *E02F 3/3636* (2013.01); *E02F 3/32* (2013.01); *E02F 3/308* (2013.01); *E02F 3/3631* (2013.01); *E02F 3/3677* (2013.01); *E02F 3/3686* (2013.01); *E02F 3/96* (2013.01)

(58) Field of Classification Search

CPC ..... E02F 3/3663; E02F 3/3631; E02F 3/3604; E02F 3/3677; E02F 3/3686; E02F 3/32

USPC ..... 414/723

See application file for complete search history.

(56) References Cited

U.S. PATENT DOCUMENTS

| | | | | |
|---|---|---|---|---|
| 2,788,906 | A | 4/1957 | Davis et al. | |
| 2,815,137 | A | 12/1957 | Johnson | |
| 3,512,665 | A * | 5/1970 | Westendorf | 414/723 |
| 3,794,195 | A * | 2/1974 | Clevenger et al. | 414/723 |
| 3,802,586 | A | 4/1974 | Lofgreen | |
| 4,571,146 | A | 2/1986 | Eriksson | |
| 4,808,061 | A | 2/1989 | Cook et al. | |
| 4,945,662 | A * | 8/1990 | Kreye | 414/723 |
| 5,171,124 | A | 12/1992 | Foster | |
| 5,315,772 | A | 5/1994 | Lalonde | |
| 5,819,445 | A | 10/1998 | Labelle et al. | |
| 6,119,377 | A | 9/2000 | Rubio | |
| 7,975,944 | B2 * | 7/2011 | Ramun et al. | 241/101.72 |

* cited by examiner

*Primary Examiner* — Gerald McClain

(74) *Attorney, Agent, or Firm* — Kyle R. Satterthwaite; Ryan W. Dupuis; Ade & Company Inc.

(57) ABSTRACT

Implements and brackets for mounting implements on the lift arms of a working machine with a front end loader configuration are disclosed. The implements and brackets are configured to enable a user to mount the implement on the lift arms of the working machine in an inverted orientation, for example in order to mount a bucket that is typically used in a forward-facing orientation for digging or clearing in an inverted rearward facing position for piercing into the ground and performing a rearward scooping action. Some embodiment includes configurations for manual or powered adjustment of a lateral position of the implement in a direction transverse to the longitudinal axis of the working machine.

17 Claims, 26 Drawing Sheets

FIG. 10A
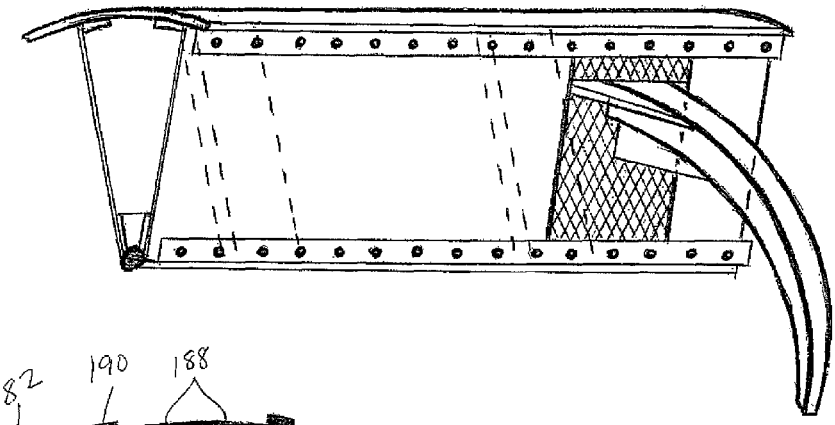
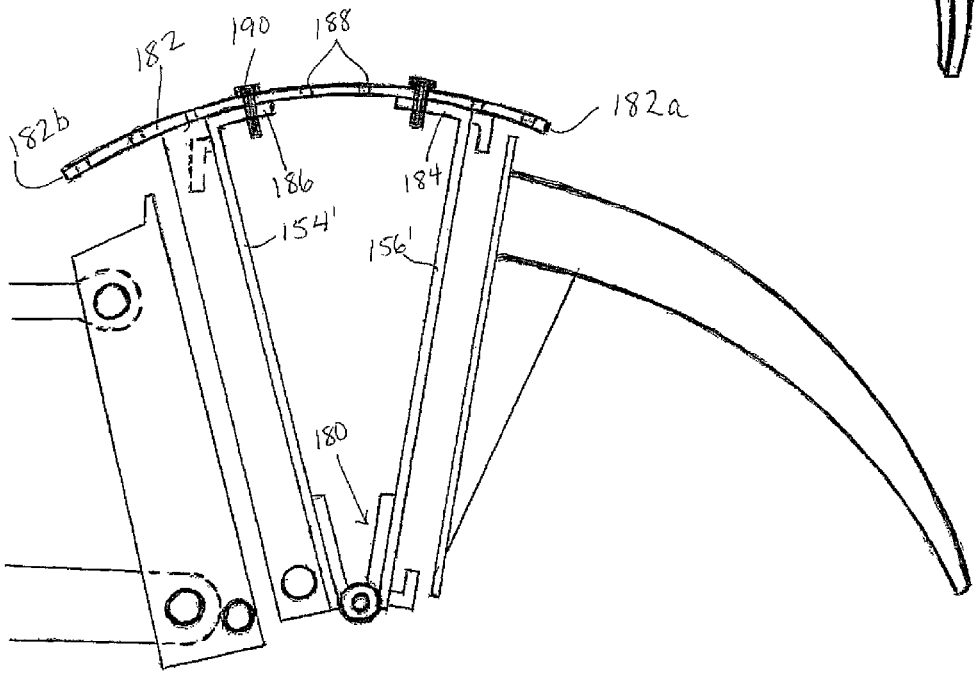
FIG. 10B

FIG. 11A
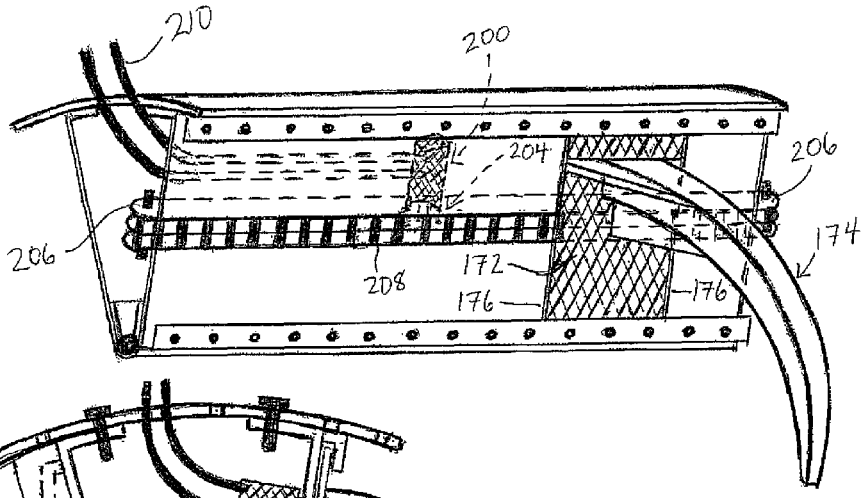
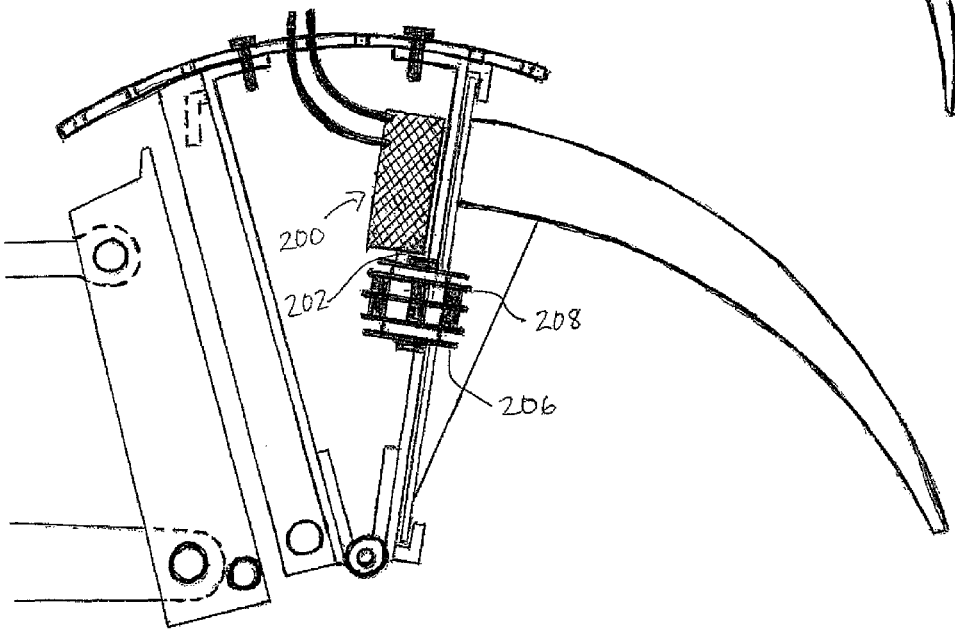
FIG. 11B

FIG. 12A
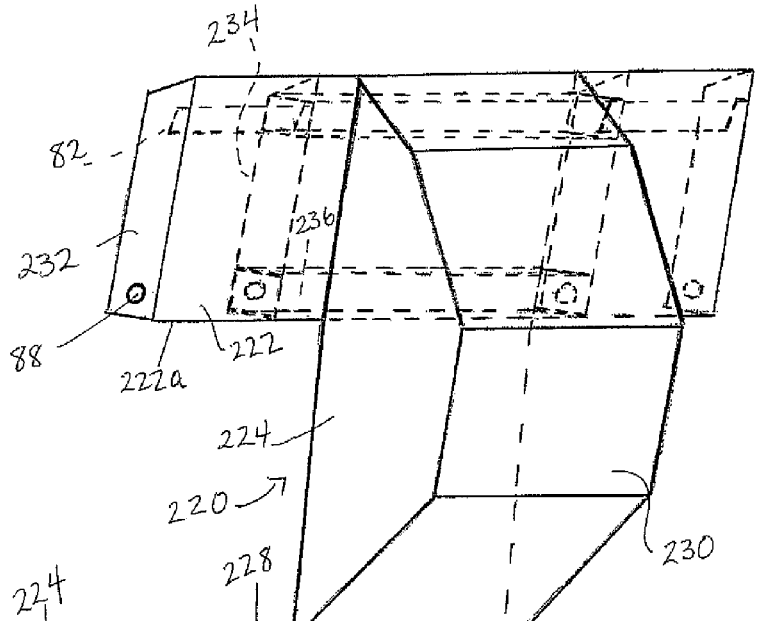
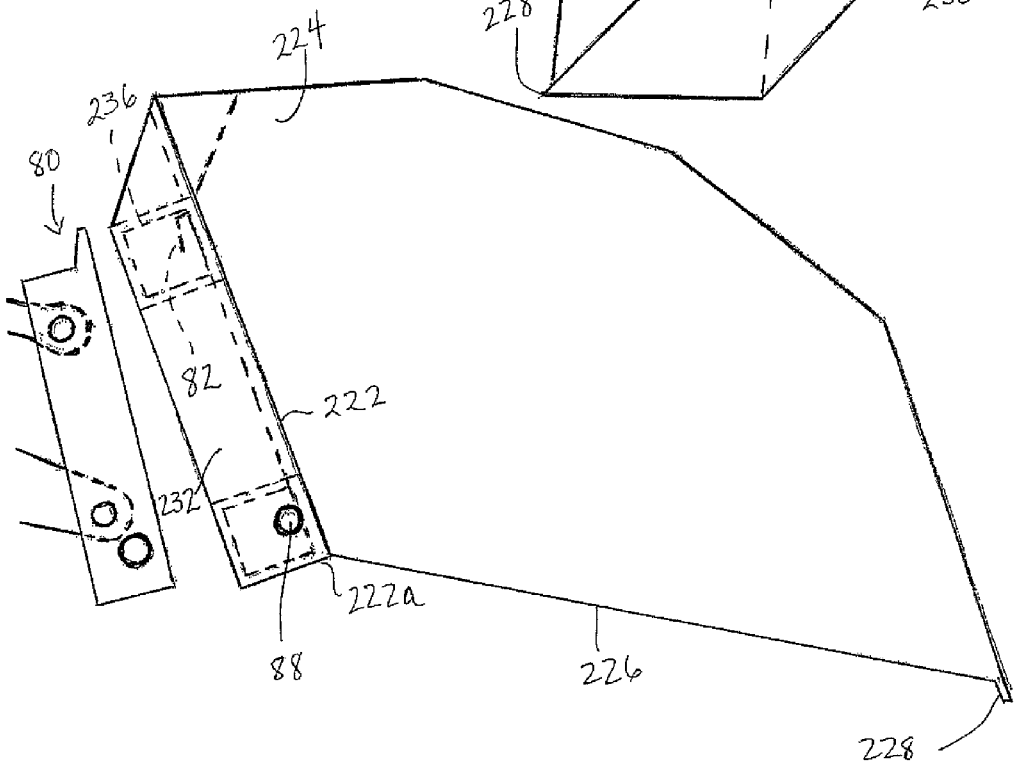
FIG. 12B

FIG. 13A
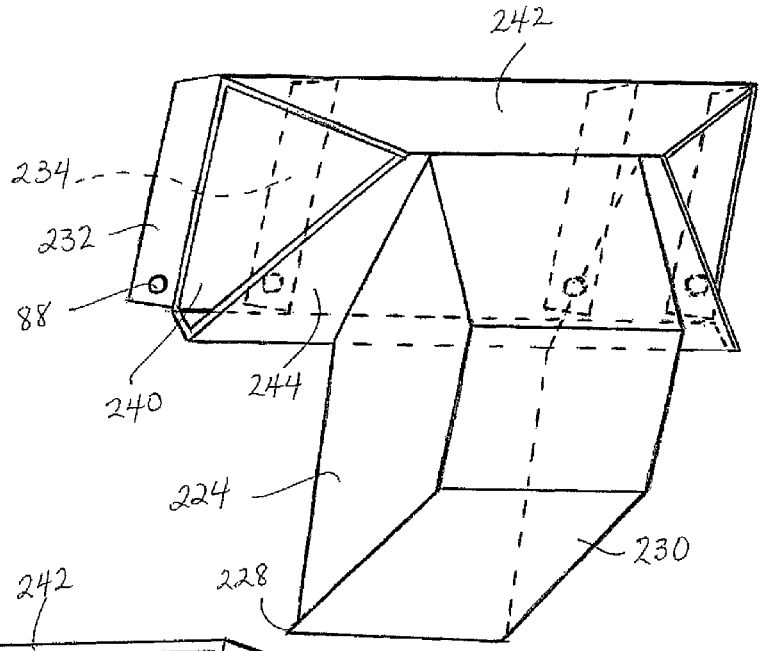
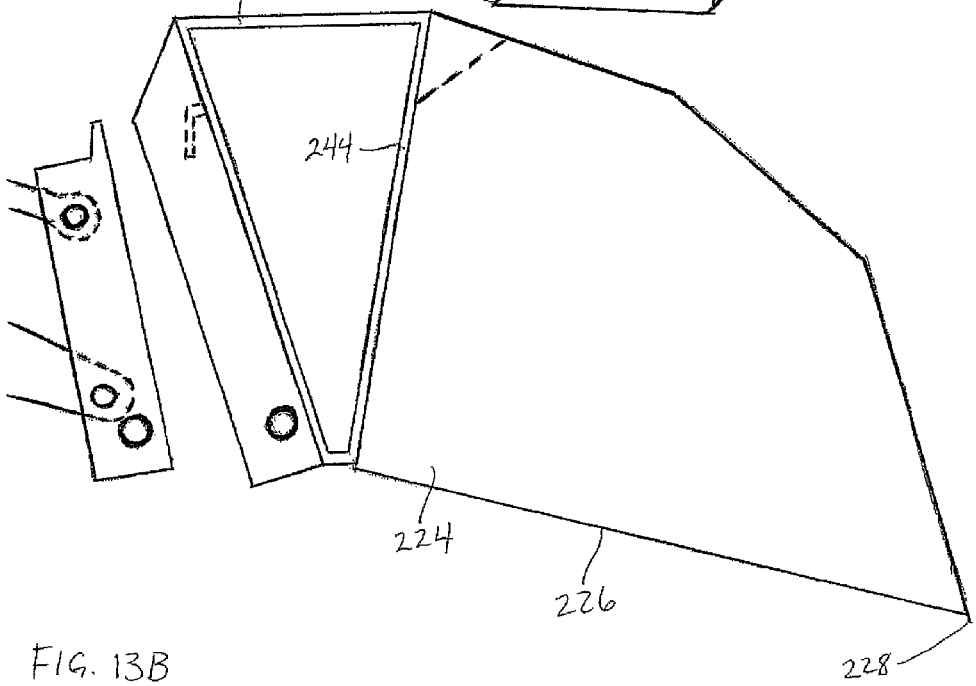
FIG. 13B 10
12

14
16
135°

135°

135°

135°

INVERTING OF ATTACHMENTS FOR WORKING MACHINES HAVING FRONT END LOADER CONFIGURATIONS

CROSS REFERENCE TO RELATED APPLICATIONS

This application claims benefit under 35 U.S.C. 119(e) of U.S. Provisional Patent Application Ser. No. 61/527,875, filed Aug. 26, 2011.

FIELD OF THE INVENTION

This invention relates to front end loaders and the like, and more particularly to devices that provide means of expanding the operational capacities of various material handling implements that would generally be attached to a loader's lift arms inverting the implement from its normal orientation.

BACKGROUND OF THE INVENTION

Today's loaders generally come equipped with one or another universal quick-attach apparatus for coupling with any of an array of specialty attachments and material handling implements. The predominant of these is the loader bucket, which is configured for attachment to the loader in an orientation in which the opening of the bucket remains forward-facing throughout its attainable range of motion. As such, any bucket's performance is thereby limited in its scope of operation to its forward thrust, rotation, and lift parameters, lacking the benefits that can be derived from an inversed, rearward facing configuration. Also, due to the same limits imposed by a forward-facing orientation, bucket width is generally limited to matching or exceeding the respective loader's overall width, as much narrower buckets tend to be impractical (i.e. in forward moving use, the bucket needs to be wide enough to clear a path for the loader to subsequently travel through). Generally, also, specialty attachments are, just like buckets, forwardly oriented and centrally fixed in coupling with the loader lift arms, lacking the benefits that can be derived from lateral manipulation, and for some, the benefits that can be derived from invertibility.

FIG. 15A illustrates a conventional back hoe arrangement on an excavation machine. The arrangement features a first boom 10 pivoted on a frame of the machine, a second boom 12 pivoted at the distal end of the first boom 10, and a back hoe bucket pivoted at the distal end of the second boom 12. Hydraulic actuators (not shown) are employed to articulate the arrangement about its four pivot points. Broken lines schematically illustrate the range of pivotal motion at each pivotal joint, demonstrating the suitability of the apparatus for trenching and deep-excavation, as the bucket can be manipulated back and forth through a range spanning from a downward-opening orientation in front of the second boom arm to a generally horizontal upward-opening orientation behind the second boom arm. Movement through this range in this order digs the downward-opening bucket into the ground, scoops the earth or other material into the bucket, where it can then be lifted away from the thusly excavated area, for example for later dumping in another area by swiveling of the excavator about an upright axis and then pivoting the bucket back through the reverse direction to revert the bucket to a downward opening orientation allowing the excavated material to fall from the bucket.

FIG. 15B illustrates a conventional front end loader configuration, such as that found on a tractor or skid steer. The number of pivot or articulation points between the frame and the machine is reduced compared to the backhoe. The machine features a pair of rigid arms 14 pivotally carried on opposite sides of the frame and linked to one another in front of the vehicle frame for movement together in parallel vertical planes by hydraulic actuators (not shown) acting to pivot the arms about their common pivot axis at the connection to the frame. At the front of these lift arms, the bucket attachment 16 is carried at a pivotal connection to the arms, and is also coupled to hydraulic actuators (not shown) on the arms to enable pivoting of the bucket about its pivotal connection to the lift arms. The connection between the frame and the lift arms and the connection between the bucket and the lift arms define the only two pivot or articulation axes of this conventional front end loader configuration.

A front end loader, in its standard forward configuration, is actually a formidable digging (excavating) machine, which is its intended primary function. In the simplest of terms, a forward movement of the machine, with the lowered bucket's nose tilted down would cause the material (earth or whatever) to be 'forced' into the bucket, and a subsequent lifting of the nose and lift arms effects a scooping action. The purpose of that action could be to a) just extract or move material for other use, or b) to carve or reshape the landscape. The loader, in requiring forward motion of the machine in order to do its work, must for every subsequent 'bucketful' enter the previously scooped spot. So its ability to 'dig' is in the nature of relatively shallow passes, and restricted to using only its standard large bucket. Taking the selected material away requires the picking up, backing up and turning and driving away and depositing movement of the machine itself.

Where a backhoe is substantially different in its operation, is that all the movements of the bucket; reach out and dig down, scoop, lift away, bring toward, move to the side, and deposit are all accomplished by articulation of the booms with the machine remaining stationary and outside the affected area. The bucket employed is relatively small. The machine's design targets deep-dig and trenching operations. In a backhoe, a prominent feature is having a rearward-facing bucket (or other implement) so that the mouth of it is facing and in plain view of the operator at all times (practically), so he can best direct and clearly see the results he's achieving.

Prior art devices have been proposed for converting a conventional front end loader configuration into a form having a bucket in an inverted rearward facing orientation.

FIG. 15C shows a solution proposed in U.S. Pat. No. 5,315,772 of Lalonde, where a smaller backhoe-type bucket 18 is attached to the existing loader bucket 16 of a utility tractor to lie beneath the bottom of the loader bucket in an orientation opening in the direction facing opposite the opening of the loader bucket. On its boom, at its nearest position vis a vis the host large bucket, the small bucket is at a distance from the pivot point no less than the overall span from the pivot point to the tip of the host bucket. It is also slave in its range of rotational motion to that of the leading edge of the host bucket. The backhoe bucket can thus dig into the ground, but without introducing another articulation point between the backhoe bucket and the loader bucket, the limited range of motion of the loader bucket prevents a full scooping action in which the backhoe bucket can be brought to a horizontal orientation opening upwardly between loader bucket and the front of the vehicle frame.

FIG. 15D shows a solution proposed in U.S. Pat. No. 6,119,377 of Rubio, where a smaller backhoe-type bucket 20 is part of an attachment 22 to be used in place of a conventional loader bucket of a skid steer loader. The attachment features a long boom arm that projects a notable distance from the connection of the attachment to the quick-attach device of the skid steer. A mounting bracket at the distal end of the boom features a number of different mounting holes for selective connection of the bucket at slightly different angles relative to the boom. Like with Lalonde's solution, the achievable range of motion of the bucket is again limited by the pivotal range achievable by the actuators on the lift arms around the pivotal connection at the end of the lift arms, and so a full scooping action may not be achievable. Instead, it is likely that the bucket initially digs into the ground and tilted to a maximum extent toward the machine about the pivotal connection to the lift arms, at which point lifting of the earth captured by the backhoe bucket is achieved by driving the machine in reverse to pull or drag the cut earth up out of the ground.

Another prior art attachment carrying an excavator bucket at the end of a boom arranged for selective connection to a front end loader is found in U.S. Pat. No. 2,815,137.

Other prior art solutions include the idea of adding a pivotal connection between the boom and bucket of a backhoe bucket attachment, and also add a hydraulic actuator on the boom for pivoting the bucket about this new articulation point. Examples of this are disclosed in U.S. Pat. Nos. 3,802,586, 4,571,146, 5,171,124, 2,788,906, 5,819,445, and 4,808,061. However, the addition of one or more extra actuators beyond those of the working machine itself adds the complexity of the solution, including the introduction of additional moving parts and the need for connection of a suitable power source (e.g. hydraulic output of the working machine) to the attachment for fully functional operation thereof.

Applicant has developed a number of unique attachment solutions for adapting a working machine with a conventional front end loader configuration into a rearward-opening inversed bucket configuration suitable for shallow excavation or scooping without reliance on additional actuators, beyond those of the machine itself, to achieve this scooping or shallow excavating motion.

SUMMARY OF THE INVENTION

According to a first aspect of the invention there is provided a working machine comprising:

a pair of rigid lift arms pivotally carried on a frame of the working machine adjacent a first end of said lift arms;

a lift arm actuation mechanism operable to pivot said pair of rigid lift arms relative to the frame;

at least one bucket actuator carried on said pair of rigid lift arms;

a bucket connection device having an inversed mode actuator connector coupled to an output of each bucket actuator and a pivotal inversed mode arm connector coupled to the lift arms adjacent a second end of said lift arms;

a bucket having an end wall, a tip distal to the end wall, and an opening spanning from the tip to an end of the opening adjacent the end wall, the end wall of the bucket being carried by the bucket connection device in a manner such that the end of the opening adjacent the end wall is positioned adjacent the inversed mode pivotal arm connector; and a control system operable to control the lift arm actuation mechanism for raising and lowering the second end of said lift arms and control the at least one bucket actuator to pivot the bucket connector and the bucket carried thereon.

According to a second aspect of the invention there is provided an implement attachment for a working machine comprising a pair of rigid lift arms pivotally carried on a frame of the working machine adjacent a first end of said lift arms and at least one implement manipulation actuator carried on said pair of rigid lift arms for tilting of an implement pivotally connected to said lift arms adjacent a second end thereof, the implement attachment comprising:

a frame;

a working implement carried at a front end of the frame; and a first set of connection features carried at a rear end of the frame, the first set of connection features comprising a first actuator connection feature arranged for releasable coupling to an output of the implement manipulation actuator and a first lift arm connecting feature arranged for releasable pivotal coupling to the lift arms adjacent the second end thereof, a second set of connection features carried at the rear end of the frame, the second set of connection features comprising a second actuator connection feature arranged for releasable coupling to the output of the implement manipulation actuator and a second lift arm connecting feature arranged for releasable pivotal coupling to the lift arms adjacent the second end thereof;

wherein the second set of connection features are inverted relative to the first set of connection features to position the second actuator connection feature adjacent the first lift arm connecting feature and the second lift arm connection feature adjacent the first actuator connection feature, whereby the working implement is selectively mountable on the working machine in a first orientation through use of the first set of connection features or in a second orientation that is inverted relative to the first orientation by use of the second set of connection features.

According to a third aspect of the invention there is provided an implement attachment for a working machine having an implement manipulation arrangement, the implement attachment comprising:

a frame;

a working implement carried on the frame; and connection features carried at a rear end of the frame and arranged in inverted sets, whereby the frame is connectable to an implement manipulation arrangement of the working machine in either a first position, or a second inverted position in which the implement is inverted relative to an orientation of the implement when the frame is connected to the implement manipulation arrangement of the working machine in the first position.

According to a fourth aspect of the invention there is provided an implement inverting bracket for inverting an orientation of an implement carried on a working machine by connection of an implement-mounted lift arm connection feature on the implement to a pair of lift arms of the working machine and connection of an implement-mounted actuator connection feature on the implement to an implement manipulation actuator carried on said lift arms, the implement inverting bracket comprising:

a frame having front and rear ends;

a frame-mounted lift arm connection feature carried on the frame at the rear end thereof and arranged for releasable pivotal coupling to the lift arms of the working machine;

a frame-mounted actuator connection feature carried on the frame at the rear end thereof and arranged for releasable coupling to the implement manipulation actuator of the working machine;

a first frame-mounted implement connection feature carried on the frame at the front end thereof and arranged for releasable coupling to implement-mounted lift arm connection feature;

a second frame-mounted implement connection feature carried on the frame at the front end thereof and arranged for releasable coupling to implement-mounted actuator connection feature;

wherein positioning of the first frame-mounted implement connection feature relative to the second frame-mounted implement connection feature at the front end of the frame is inverted compared to positioning of the frame-mounted lift arm connection feature relative to the frame-mounted actuator connection feature at the rear end of the frame.

According to a fifth aspect of the invention there is provided an implement attachment for a front end loader comprising lift arms and loader actuators on the lift arms with an arrangement for pinned connection of an implement to the lift arms and loader actuators, the implement attachment comprising:

a working implement; and attachment brackets connected to the working implement at a rear end thereof to project rearwardly therefrom, the attachment brackets comprising a first set of pin holes arranged in a first series extending away from the implement and a second set of pin holes arranged in a second series extending away from the implement at a distance along the brackets from the first series, whereby switching between which one of the series is used for pinned connection to which one of the lift arms and the actuators allows an orientation of the working implement to be inverted on the lift arms.

According to a sixth aspect of the invention there is provided an implement attachment bracket for a front end loader comprising lift arms and loader actuators on the lift arms with an arrangement for pinned connection of an implement to the lift arms and loader actuators, the implement attachment bracket having parallel planar portions of tapered shape with a wide end and an opposing narrower end, a series of actuator pin holes extending through the parallel planar portions and spaced along the wide end for user-selection of which actuator pin hole in the series to use to pin the bracket to the loader actuator, a lift-arm pin hole adjacent the narrower end of the planar portions for pinned connection of the bracket to the lift arm, and a pair of implement pin holes positioned in a thinner portion of the bracket residing between planes of the parallel planar portions and extending between the wide and narrow ends thereof.

According to an seventh aspect of the invention there is provided a method of adapting a working machine with a front end loader configuration for an inverted-bucket operation, the method comprising:

(a) providing a bucket having an end wall, a tip distal the end wall, and an opening spanning from the tip toward the end wall;

(b) mounting a bucket on the front end loader configuration in a position placing an end of the opening nearest the end wall at a location adjacent where a connection of the bucket to front end loader configuration pivots on lift arms of the front end loader configuration.

According to a eighth aspect of the invention there is provided a method of digging using a working machine with a front end loader configuration, the method comprising:

(a) providing a bucket having an end wall, a tip distal the end wall, and an opening spanning from the tip toward the end wall;

(b) mounting a bucket on the front end loader configuration in a position placing an end of the opening nearest the end wall at a location adjacent where a connection of the bucket to front end loader configuration pivots on lift arms of the front end loader configuration; and (c) manipulating the bucket using the front end loader configuration to position the bucket in a downward opening position over the area to be dug out; and (c) pivoting the bucket about the connection of the bucket to the lift arms to move the tip of the bucket about this connection in a direction initially downward into the area to be dug out and through a sufficient angular range about this connection to move the tip upwardly toward the working machine in a scooping action.

According to a ninth aspect of the invention there is provided an invertible-implement attachment system for a working machine having a front end loader configuration, the system comprising:

a frame comprising a frame front end and an opposing frame rear end arranged for selective connection to the front end loader configuration of the working machine for manipulation thereby; and a working implement comprising a base having a base front end and an opposing base rear end, and a working member projecting from the base front end;

wherein the base has first and second base connection portions each comprising at least one base connection feature, the front end of the frame has first and second frame connection portions each comprising at least one frame connection feature, the first and second base connection portions are spaced apart by a distance equal to spacing apart of the first and second frame connection portions, the frame connection features of the first and second frame connection portions are the same as one another, and the base connecting features are of a type compatible with the frame connecting features to allow connection of either base connection portion to either frame connection portion to achieve for user-selection between inverted orientations of the implement on the frame.

According to a tenth aspect of the invention there is provided a invertible-implement attachment system for a working machine having a front end loader configuration, the system comprising:

a frame comprising a frame front end and an opposing frame rear end arranged for selective connection to the front end loader configuration of the working machine for manipulation thereby; and a working implement comprising a base having a base front end and an opposing base rear end, and a working member projecting from the base front end;

wherein the base comprises base connection features, the front end of the frame comprises frame connection features of a type compatible with the base connecting features, and the connection features are arranged to enable connection of the base and frame to one another via pairing of connection features between the frame and the base in different orientations of the base relative to the frame.

According to an eleventh aspect of the invention there is provided a laterally adjustable implement attachment system for a working machine having an implement manipulating arrangement, the system comprising:

a frame comprising a frame front end and an opposing frame rear end arranged for selective connection to the implement manipulating arrangement of the working machine for manipulation thereby; and a working implement comprising a base having a base front end and an opposing base rear end, and a working member projecting from the base front end;

wherein the frame comprises at least one channel member each extending along a respective one of top and bottom edges of the front end of the frame, the channel member forming a slot sized for receipt of a respective portion of the base of the implement in said slot in a manner slidable therealong, and the frame comprises multiple frame connection features at locations spaced apart along a direction in which each channel members extends, each frame connection feature being connectable to a base connection feature on the base of the implement to secure the implement to the frame at a position along the channel at which said base connection feature aligns with said frame connection feature.

BRIEF DESCRIPTION OF THE DRAWINGS

In the accompanying drawings, which illustrate exemplary embodiments of the present invention:

FIG. 5B is a rear perspective view of the fourth embodiment invertible bucket showing a set of adjustable connection elements moved out of their position in FIG. 5A where they lie coplanar with a set of fixed connection elements to adjust the orientation of the bucket for an inverse bucket operation.

FIG. 10A is a front perspective view of a variant of the sixth embodiment invertible implement system, in which angular adjustability between the front and rear ends of the connection between the implement and the quick attach system of the skid steer loader is added.

FIG. 10B is a side elevational view of the invertible implement system of FIG. 10A.

FIG. 11A is a front perspective view of a further variant of the sixth embodiment invertible implement system, in which a motorized system for lateral adjustment of the implement is added.

FIG. 11B is a side elevational view of the invertible implement system of FIG. 11A.

FIG. 12A is a front perspective view of a seventh embodiment bucket attachment for dedicated use in only a inversed, rearward-mode orientation of a skid steer loader of the type employing the quick attach system of FIG. 3A.

FIG. 12B is a side elevational view of the bucket attachment of FIG. 12A.

FIG. 13A is a front perspective view of a variant of the seventh embodiment bucket attachment.

FIG. 13B is a side elevational view of the bucket attachment of FIG. 13A.

DETAILED DESCRIPTION

Figure 1A:
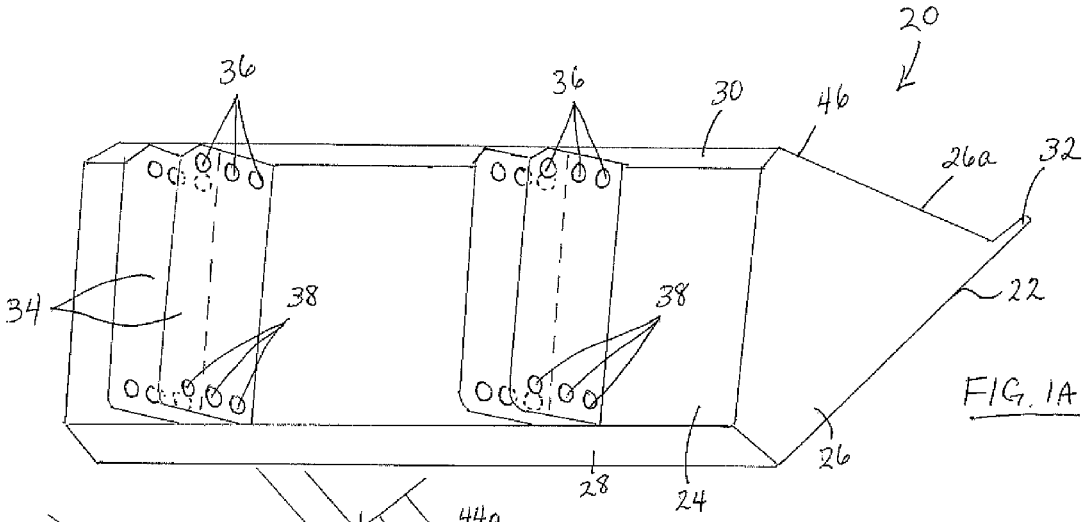
FIG. 1A is a rear perspective view of a first embodiment invertible bucket for a conventional front end loader employing pinned connections for attachment of implements to its lift arms and actuators carried thereon.

FIG. 1 shows a first embodiment of the invention, which features a loader bucket 20 having a bottom wall 22, a rear wall 24, and at each end of these walls 22, 24, a respective side wall 26 spanning between them with a sloped front edge 26*a* lying obliquely relative to both the bottom and rear wall. In the illustrated embodiment, a bottom-rear connection wall 28 obliquely joins the bottom wall 22 to the rear wall 24, and a top wall 30 juts a short distance upward and forward from the top end of the rear wall 24 to where the side wall 26 then continues downward and forward to the bottom wall at the sloped front edge 26*a*. The terms top, bottom, front and rear are used in terms of the normal ground-level loader position of the bucket shown in FIG. 1B, where the bottom wall 22 lies horizontally at ground level and the opening of the bucket, bound by the bottom wall 22 and the front or leading edges of the side walls 26 and top wall 30 opens in a forward direction away from the wheel or track conveyed vehicle frame of the working machine on which the bucket is to be carried by lift arms of a front end loader configuration. A working edge or tip of the bucket 32 that is the first to engage earth or other material to be conveyed by the bucket is formed at the leading edge of the bottom wall 22.

Projecting perpendicularly from the plane of the flat rear wall 24 at the rear face thereof are four bracket plates 34 lying parallel to the side walls 26 and arranged in two pairs, each pair being nearer a respective one of the side walls 26. In each bracket plate, a series of upper holes 36 are spaced apart from one another along an upper edge of the plate 34 projecting perpendicularly from the plane of the rear wall 24 at or near the upper edge thereof, and a series of lower holes 38 are spaced apart from one another along a lower edge of the plate 34 projecting perpendicularly from the plane of the rear wall 24 at or near the lower edge thereof. Each hole in each bracket plate aligns with a respective hole in each of the other bracket plates.

The first embodiment bucket is designed for use with a front end loader 40 for which pins are used to accomplish coupling of attachments to the pivotally-carried rigid lift arms 42 of the working machine and to the bucket manipulating actuators 44 carried on the lift arms. Accordingly, with reference to FIG. 1B, for use of the bucket 20 for a loader-type operation, the eye or hole in the external end of the piston rod 44*a* of each hydraulic cylinder actuator 44 is axially aligned with one set of aligned upper holes 36 in the bracket plates 34 at a position between a respective one of the bracket plate pairs so that a pin can then be secured in the aligned holes of that actuator and respective pair of bracket plates to pivotally secure that pair of bracket plates to the piston rod of the actuator 44. Likewise, a transverse through hole in each lift arm 42 of the working machine is axially aligned with one set of aligned lower holes 38 in the bracket plates 34 at a position between a respective one of the bracket plate pairs so that a respective pin can then be secured in the aligned holes of that lift arm and respective pair of bracket plates to pivotally secure that pair of bracket plates to the lift arm 42. Having accomplished a pinned, pivotal connection of the brackets at the output of the actuators and at the distal ends of the lift arms, raising and lowering of the lift arms by operation of the lift arm actuators of the working machine will raise and lower the attached bucket 20, while extending and contracting the actuators 44 on the lift arms will tilt the tip 32 of the bucket 20 up and down by pivoting the bucket about its pivotal connection to the lift arms. The bucket is thus operational in the conventional context of a front end loader.

Figure 1B:
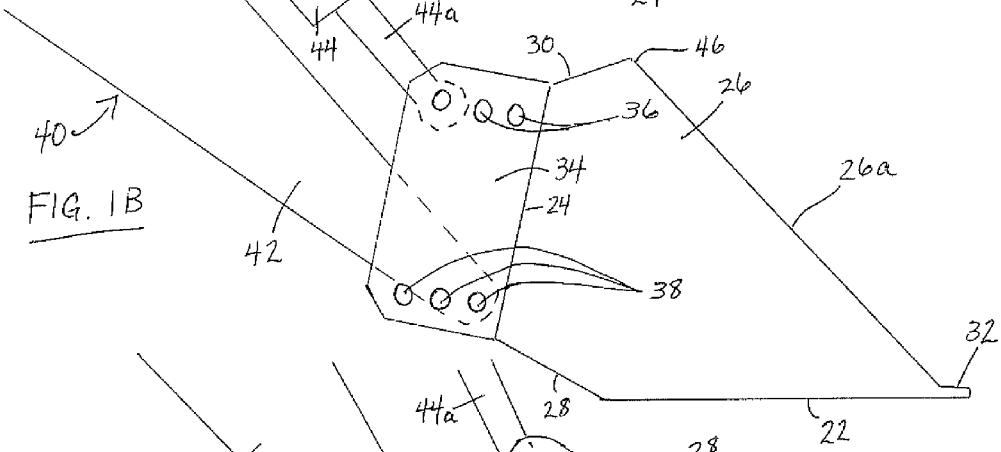
FIG. 1B is a side elevational view of the first embodiment invertible bucket in a forward-mode orientation corresponding to normal use of a conventional loader bucket.
Figure 1C:
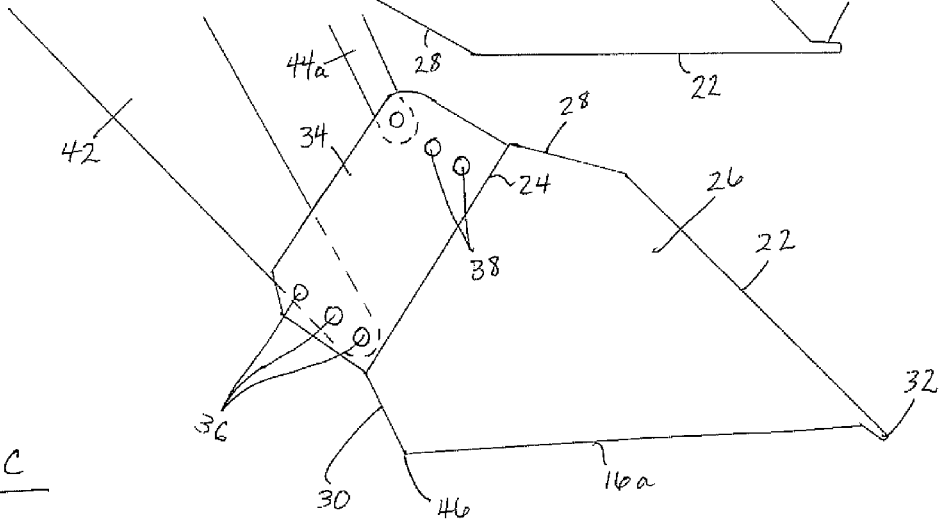
FIG. 1C is a side elevational view of the first embodiment invertible bucket in an inversed, rearward-mode orientation accomplished by use of the present invention.
Figure 1D:
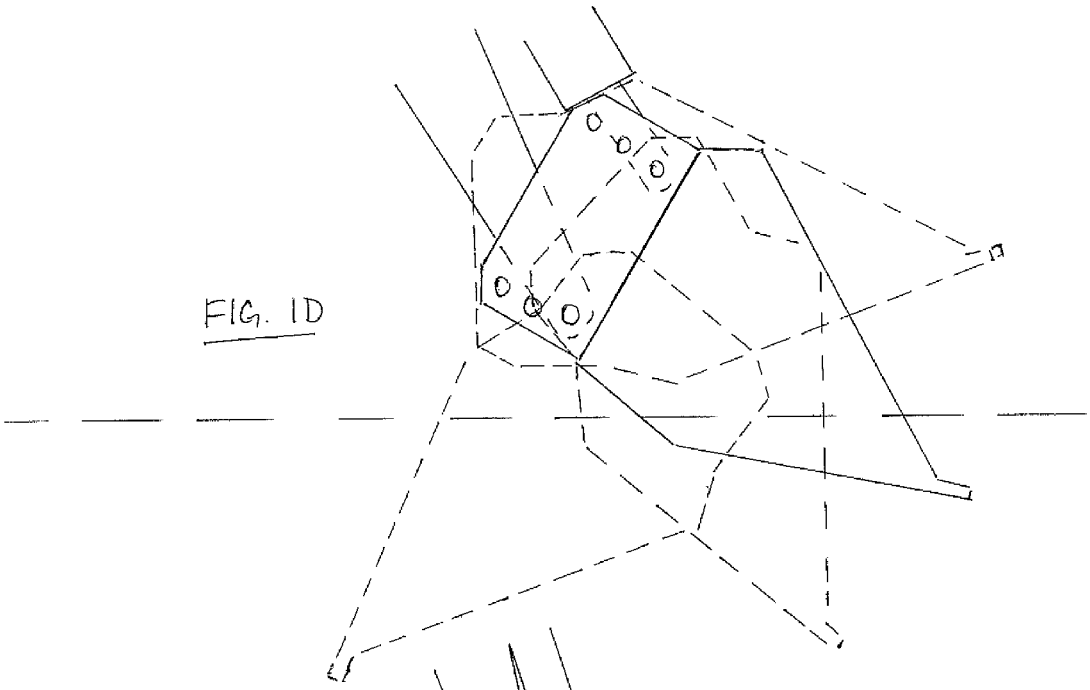
FIGS. 1D and 1E illustrate the rotational range of the invertible bucket in the mounted orientations of FIGS. 1B and 1C respectively.
Figure 1E:
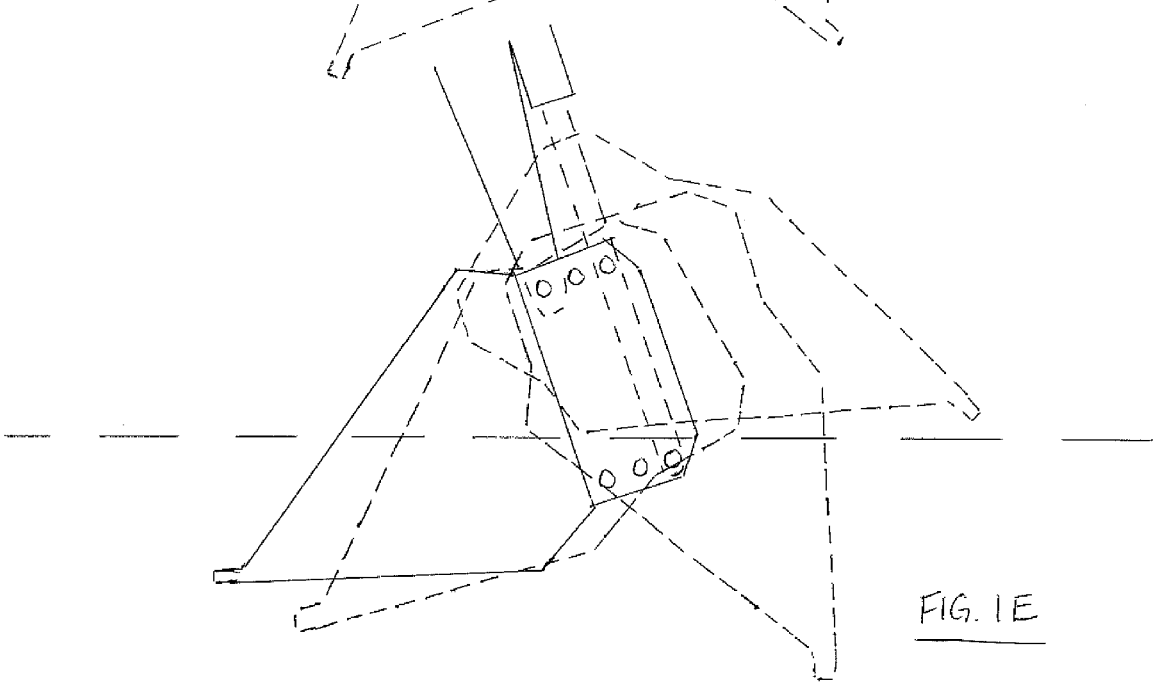

With respect to FIG. 1C, the bucket 20 is also connectable to the working machine in an orientation that is inverted relative to the conventional orientation of FIG. 1B. To accomplish this, the bucket is positioned to lie its opening, rather than its bottom wall 22, along the ground. Then, the eye or hole in the external end of the piston rod 44*a* of each hydraulic cylinder actuator 44 is axially aligned with one set of aligned lower holes 38 (which now occupy an upper position due to the inversion of the bucket) in the bracket plates 34 at a position between a respective one of the bracket plate pairs so that a pin can then be secured in the aligned holes of that actuator and respective pair of bracket plates to pivotally secure that pair of bracket plates to the piston rod of the actuator 44. Likewise, a transverse through hole in each lift arm 42 of the working machine is axially aligned with one set of aligned upper holes 36 (now in a lower position due to the inversion of the bucket) in the bracket plates 34 at a position between a respective one of the bracket plate pairs so that a respective pin can then be secured in the aligned holes of that lift arm and respective pair of bracket plates to pivotally secure that pair of bracket plates to the lift arm 42. Having accomplished a pinned, pivotal connection of the brackets at the output of the actuators and at the distal ends of the lift arms, raising and lowering of the lift arms by operation of the lift arm actuators of the working machine will raise and lower the attached bucket 20, while extending and contracting the actuators 44 on the lift arms will tilt the tip 32 of the bucket 20 up and down by pivoting the bucket about its pivotal connection to the lift arms.

The providing of more than one pair of holes in each bracket plate 34, for example providing the illustrated series of three holes at each of the upper and lower areas of each bracket plate, allows the lift arms and actuators of the working machine to connect to the brackets at different locations thereon in the two different modes. This has a benefit in that the different connection points can be used to optimize the orientation of the bucket relative to the plane occupied by the two pivot axes of these connections to the lift arms and actuators of the working machine. For example, if the pair of bracket holes used to connect the bucket for conventional operation in FIG. 1B were also used to connect the bucket for inverse-mode operation, then the opening of the bucket in the inverse-mode would be oriented in a more steeply sloped plane than that shown in FIG. 1C for the same lift arm and actuator position. For inverse operation, this means connecting the lift arm using a hole that is nearer the bucket's rear wall in the first series of holes 36 than the hole used in first series 36 to connect the actuator for conventional operation, and connecting of the actuator using a hole that is further from the bucket's rear wall in the second series of holes 38 than the hole used in second series 38 to connect the lift arm for conventional operation. As a result, in downward opening/inverse orientation of FIG. 1C, the tip or working end 32 of the bucket is positioned lower than it otherwise would, positioning the bucket in a position closer to a tip-down orientation suitable for piercing the bucket into the ground to start a scooping action.

Figures 15A, 15B, 15C, 15D, 15E:
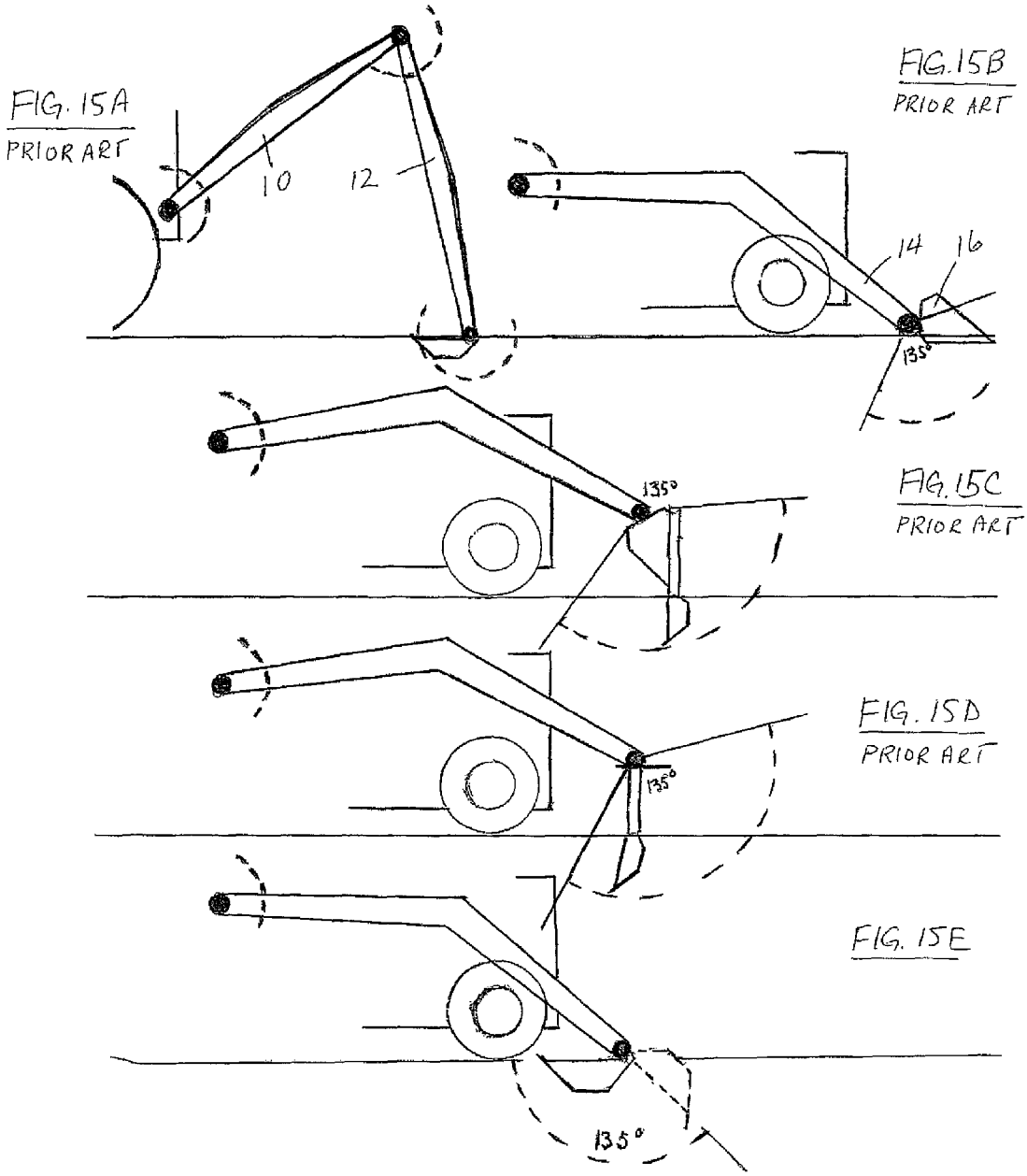
FIG. 15A PRIOR ART
FIG. 15B PRIOR ART
FIG. 15C PRIOR ART
FIG. 15D PRIOR ART
FIG. 15A illustrates the rearward oriented functionality of a conventional backhoe excavator employing three horizontal pivot axes plus one base vertical pivot axis.
FIG. 15B illustrates the forward oriented functionality of conventional front end loaders employing and limited by having only 2 vertical plane pivot points (i.e. 2 horizontal pivot axes).
FIG. 15C illustrates one prior art proposal for expanding the functionality of conventional front end loaders that come equipped with a standard bucket.
FIG. 15D illustrates another prior art proposal for expanding the functionality of front end loaders that come equipped with a quick attach system.
FIG. 15E illustrates the added digging functionality of front end loaders employing the present invention.

Referring to FIG. 15E to illustrate use of the present invention for a rearward digging operation using a front end loader, with the bucket mounted in an inverted downward-opening position with the bucket actuators of the working machine in a collapsed state, having the tip of the bucket low means that for the range of pivotal bucket motion attainable by extending the bucket actuator from this initial collapsed state, the tip of the bucket will be able to move further toward the frame of the working machine to reach or approach an orientation placing the bucket opening horizontal in order to securely carry the dug up earth on the bottom wall of the bucket. Having the brackets with the connection features mounted directly on the rear wall of the bucket means that the rear wall 24 of the bucket, and thus the rear end 46 of the bucket's opening (which in the illustrated embodiment is defined at the peak of the side wall 26 at the front/leading edge of the top wall 30), are positioned adjacent the pivotal connection of the bracket to the lift arms of the machine in very close proximity to this pivot axis, unlike prior art arrangements in which a bucket is carried at the distal end of an arm or boom at a significant distance from this pivot axis. As the radial arm distance from the pivot axis at the lift arm connection to any given point on the bucket is less for this boomless connection of the present invention, the actual distance traveled by bucket for a given angular range of pivoting is less. Accordingly, in pivoting the tip of the bucket downward into the ground, the amount of material cut from the surrounding earth by the bucket is more comparable to a quantity of material the bucket is capable of carrying in a scooping action.

The first embodiment thus provides an attachment for gaining invertibility and changeable rotational field by means of a fixed, integral receiving structure suited to couple with the loader's boom arms and lift cylinders via their respective hole/pin mechanisms.

Figure 2:
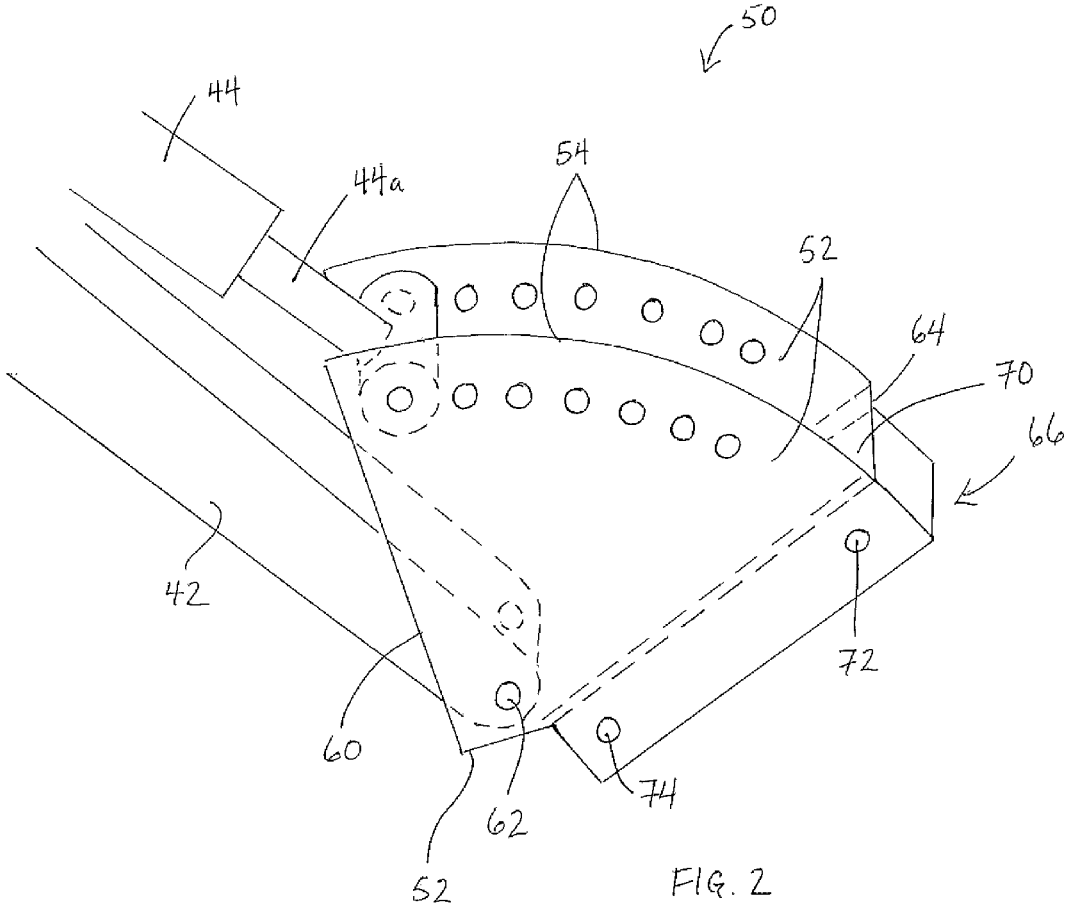
FIG. 2 is a side perspective view of a second embodiment inverting bracket for inverting a prior art bucket of a conventional front end loader of the type referenced for FIG. 1, thereby enabling use of the bucket in the inversed, rearward-mode orientation.

FIG. 2 shows a second embodiment of the present invention for use on the same type of front end loader machine as the first embodiment of FIG. 1. The second embodiment does not feature its own bucket, but instead is an attachment bracket 50 to be used on each lift arm of the machine for mounting of an existing loader bucket in an inverted operating orientation.

The attachment bracket 50 features two side wall plates 52 of identical shape that are spaced apart from one another by a distance sufficient to accommodate the distal end of the lift arm and the eye-featuring distal end of the actuator piston rod 44*a* between them. The planar side wall plates 52 are aligned with one another in a direction perpendicular to their parallel planes. Each side wall plate has a downwardly tapered shape having a wider upper end 54 and a narrower lower end 56 thereopposite. A series of upper holes 58 is provided in each side wall plate 52, and features holes arcuately spaced along an arcuate path near the upper edge 54 of the side plate 52, starting from near a rear end 60 of the side wall plate 52 toward an opposing front end. In the illustrated embodiment, each side wall plate is nearly sector-shaped, somewhat resembling a piece of pie that has been cut off or truncated near its point or tip to define the narrow lower end of the wall. Accordingly, the upper edge 54 of the side wall plate is arc-shaped, the arcuately-spaced upper holes thus following along the upper edge a short distance downward therefrom. A single lower hole 62 in each side plate is located near the lower edge 56 of the side wall plate 52 at a radial center of the arcuate path of the upper hole series. Each hole in each side wall plate 52 axially aligns with a respective hole in the other side wall plate 52.

At front ends 64 of each side wall plate 52, the bracket 50 features a thinner section 66 also having opposing, planar, outwardly facing sides 68, but being thinner than the part of the bracket with the tapered side walls 52 so that each of these outwardly facing sides 68 is located somewhat inward from the respective one of the side wall plates 52. In the illustrated embodiment, the two side wall plates 52 are joined at their front ends by a planar front wall 70 lying perpendicular to the planes of the side wall plates 52. The thinner section 66 is rigidly fixed to this front wall 70, for example by welding, and may be provided in the form of a piece of rectangular tubing running along the front wall 70, or a pair of plate members projecting from the front wall and interconnected thereby. It may be possible to form the front and side walls of the tapered part of the bracket by bending a singular plate into the appropriate form. The thinner front portion of the bracket 66 features two through holes 72, 74 extending therethrough in the transverse direction parallel to the axes of the holes in the side wall plates 52 near the top and bottom of the thinner portion, which is substantially coterminous at its top and bottom ends with the front end of the thicker rear portion of the bracket. The upper hole 72 of the thinner front portion 66 is spaced from the lower hole 74 therein along the front ends of the side wall plates by a distance corresponding to spacing apart of respective pin holes provided at the rear of the existing loader bucket.

To use the bracket 54, the eye-end of the actuator piston rod 44*a* is pinned to a pair of upper holes in the two side wall plates 52, and the pivot connection hole near the end of the respective lift arm is pinned to the single pair of lower holes in the two side wall plates 52. With the front ends of the side wall plates sloped downwardly back toward the rear end of the bracket, the plane of the connection holes 72, 74 at the thinner front portion of the bracket is tilted obliquely forward and downward about its lower end relative to the plane in which the pivot axes of the actuator and lift arm connections to the bracket reside. The thickness of the front portion 66, i.e. the perpendicular distance between the flat outer faces thereof, is selected so as to fit between the respective pair conventional bracket plates on the rear of the bucket, where the eye of the piston rod actuator and distal end of the lift arm would normally be received for pinned connection to the bucket for use in a conventional loader-orientation. Accordingly, in using the bracket 50 of the present invention, the thinner front portion 66 thereof fits between the bracket plates on the rear of the bucket, except that the bucket is placed in an inverted position opening downward. Accordingly, the top hole 72 of the bracket's front portion 66 is pinned to the connection hole on the bucket that is near what is normally the bottom wall of the bucket, and the bottom hole 74 of the bracket's front portion 66 is pinned to the other connection hole at the rear of the bucket near the bucket opening.

Accordingly, with the bucket attached to the bracket, the opening of the bucket will face downward and rearward (i.e. downward and toward the front end of the vehicle frame of the working machine) when the lift arms are in a downward and forward extending position like that of FIG. 2 corresponding to normal ground level positioning of an upward-facing loader bucket for conventional loader use, or a position slightly elevated above ground in front of the machine. With reference to FIG. 15E, this downward and rearward-opening orientation of the bucket (as shown in broken lines) forms a good starting position for a rearward digging operation. Extending the piston rod 44*a* of the actuator 44 from its initial contracted or partially contracted state of FIG. 2 will thus pivot the tip of the bucket further downward and rearward to begin a scooping action of the bucket, with continued extension of the actuator continuing this pivoting action on the bucket around the lift-arm connection thereof to bring the bucket tip upward and rearward to complete the scooping action by reaching or approaching the solid-line position of the bucket in FIG. 15E.

The second embodiment thus provides a separate and distinct (from the bucket) autonomous device that provides invertibility and changeable rotational field. In this embodiment/s the device serves as intermediary between loader boom lift arms c/w hydraulic cylinders and the respective attachment, coupling with all via their respective hole/pin mechanisms in a variety of combinations.

The first embodiment thus provides a replacement bucket that can be substituted for a conventional loader bucket, or alternately a weld-in-place replacement attachment bracket for an existing bucket, for optional use in either a conventional upward-opening orientation, or a downward-opening orientation, while the second embodiment instead provides an add-on bracket that can be used with a conventional loader bucket to adapt its mounting position and orientation for suitability for alternative inverse operations.

The first two embodiments display pin-hole type connection features for suitability with loaders employing a conventional pin-type connection at each lift arm and bucket actuator. Other embodiments will now be described in terms of quick-attach systems, such as those more recently and commonly employed, which reduce the number of pinned connections required in order to simplify the connection and disconnection of a bucket or other implement attachment.

Figure 3A:
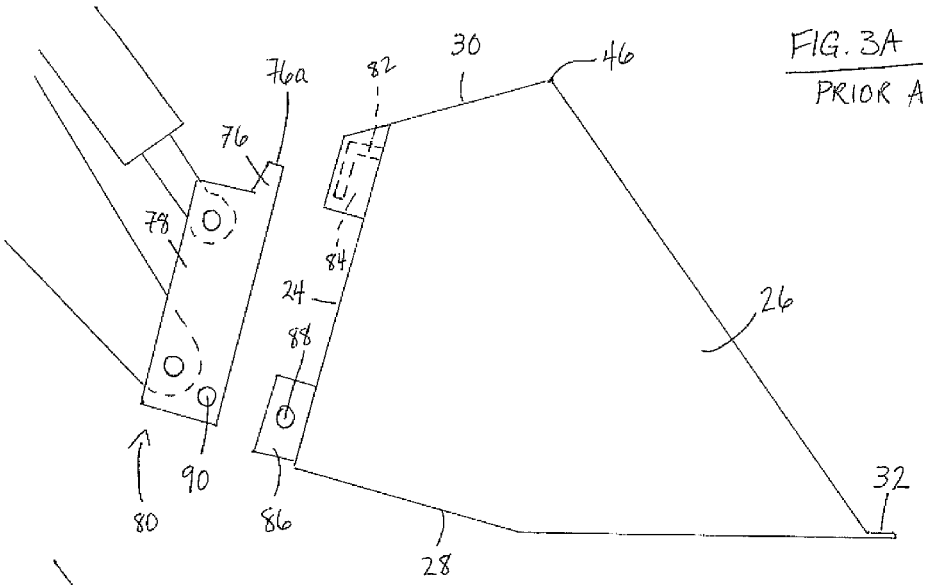
FIG. 3A PRIOR ART
FIGS. 3A and 3B are side elevational views of prior art quick attach systems conventionally used to attach implements to front end loaders.

FIG. 3A illustrates one such prior art quick attach system. The quick attach system features main plates 76 that are pivotally connected to respective ones of the lift arms 42 and the respective actuators 44 on those lift arms, for example by way of pairs of aligned holes in connector plates 78 that project perpendicularly from each main plate 76 at or near its opposing upstanding ends. The two main plates 76, each lying in front of a respective lift arm of the machine, are tied together in the cross-wise direction of the machine by one or more cross-members for movement as an assembled unit 80. Each main plate 76 projects upward past the top end of its connector plates 78 to present a top edge 76*a* of the main plate at a distance above the rest of the quick attach unit. The coplanar top edges 76*a* of the main plates 76 are tiltable forward and rearward about the pivotal connection to the lift arms by extension and retraction of the actuators. Accordingly, the actuators will function to likewise tilt or pivot any implement attachment that is coupled to the main plates 76. The quick-attach unit 80 is intended to be left on the machine, and the machine owner or operator can purchase various attachments configured to releasably couple to the unit 80 in a quick-attach, quick-release manner.

Each such attachment thus features a bucket or other implement with a suitable quick-attach bracket configuration at the rear end thereof for coupling with the quick-attach unit 80 of the machine. Still referring to FIG. 3A, near each end of the rear wall 24 a short distance below the rear wall's top edge, a channel 82 is fixed to the rear wall in a downward opening orientation to create a slot 84 between the rear wall 24 and the downward depending leg 82*a* of the channel positioned a short distance outward from the bucket's rear wall 24. The width of this slot between the bucket's rear wall and depending leg slightly exceeds the thickness of the upper edge 76*a* of each main plate 76 of the quick-attach unit 80 on the working machine. Also near or at each end of the rear wall 24 of the bucket, but at a short distance above the rear wall's bottom edge, a small plate 86 projects perpendicularly rearward from the rear wall 24 of the bucket along the edge thereof at which the bucket side wall connects to the rear wall 24, and features a hole 88 passing through it in the transverse direction. This hole is alignable with a pair of aligned holes 90 in the connector plates 78 of the respective main plate 76 of the quick attach unit 80 on the machine.

In a quick attach system of this type, the quick attach unit 80 is positioned a short height above the ground using the machine's lift arms 42 and manipulated using the lift arms and the actuators carried thereon to insert the upper edges 76*a* of the main plates of the quick attach unit 80 upward into the slots 84 of the respective channel members 82 on the rear of the bucket. The distance from the upper edge 76*a* of each main plate 76 to the respective aligned holes 90 in the connector plates 78 on the quick attach unit matches the distance from the closed upper end of each channel slot 84 to the hole in the respective small lower plate 86 on the rear of the bucket. Accordingly, the hole 88 of the bucket's small lower connection plate 86 is alignable with the holes 90 in the connector plates 78 of the quick attach unit when the top edges of the quick attach unit are received in the channel members 82 of the bucket, at which point a horizontal pin is used at the aligned holes 88, 90 at each lift arm to cooperate with the engagement of the projecting upper portion of the main plates 76 of the quick attach unit with the slot of the channel members 82 on the bucket in order to secure the bucket onto the quick-attach unit.

Figure 3B:
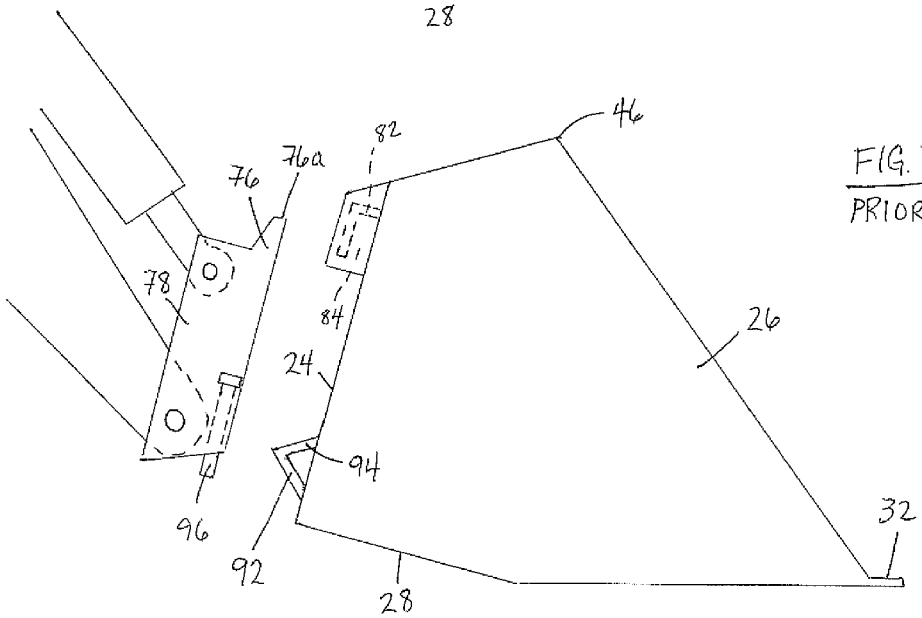
FIG. 3B PRIOR ART

The quick attach system of FIG. 3B is similar to that of FIG. 3A, except that the pinned connection between the quick attach unit and the bucket takes place in a different direction. Instead of upright end plates on the bucket's rear wall providing transverse-direction holes alignable with matching holes in connector plates of the quick attach unit, this system features a ledge 92 projecting from the bucket rear wall 24 at or shortly above the bottom edge thereof in parallel alignment therewith, and a number of holes 94 extending downward into the ledge at spaced locations therealong for receipt of locking pins 96 arranged to be extendable downward from a bottom of the quick attach unit 80. The operation of the system is similar to that of FIG. 3A, using engagement of the projecting upper ends of the plates 76 of the quick attach unit 80 into downward opening slots or channels near the top of the bucket rear wall as one connection point between of the bucket to the quick attach unit, and using engagement of locking pins near the bottom of the rear wall to form a second connection point fixing the position of the bucket on the quick attach unit.

Figure 4A:
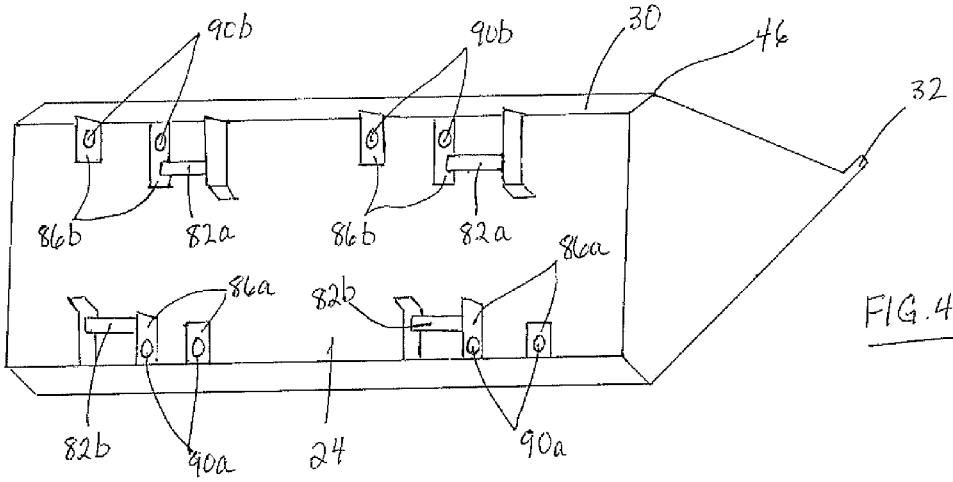
FIG. 4A is a rear perspective view of a third embodiment invertible bucket for a conventional loader of the type employing the quick attach system of FIG. 3A. All drawings involving a quick attach are presented in the context of the representative quick attach type shown in FIG. 3A, while the invention encompasses the necessary modifications to the device(s) to accomplish their use in all alternate quick attach systems.

Turning now to FIG. 4A, a third embodiment of the present invention is a bucket attachment of a type configured for connection to a quick-attach system of the type shown in FIG. 3A in a first upward-opening conventional position, or in a second downward-opening inverse position. The bucket has the same configuration of walls as those of FIGS. 1 and 3, and so the same reference numbers and terminology are used in accordance therewith. On the rear wall 24 of the bucket, a first set of connectors fixed to the rear wall features two upper channel members 82*a* mounted near the top edge of the rear wall 24 in downward opening orientations at positions respectively nearer a respective end of the rear wall, and two pairs of small bottom plates 86*a* each positioned nearer a respective end of the rear wall to generally align the two plates of the pair with the two ends of a respective one of the upper channel members 82*a*. Each bottom plate 86*a* features a horizontal through hole 90*a* aligning with that of the other bottom plates. This first set of connectors is thus cooperable with the quick attach unit of FIG. 3A in the same manner as the channel and pin-hole connectors of the bucket of FIG. 3A in order to releasably mount the bucket on the quick attach unit in an upward-opening orientation suitable for use of the working machine in a conventional operating working mode.

The bucket of FIG. 4A differs from the conventional quick attach bucket however, in that a second set of connectors is provided on the rear wall of the bucket for alternatively accomplishing mounting of the bucket on the quick attach system in an inverted, downward/rearward-opening position. This second set thus features two lower channel members 82*b* mounted near the bottom edge of the rear wall 24 in upward opening orientations at positions respectively nearer a respective end of the rear wall, and two pairs of small top plates 86*b* each positioned nearer a respective end of the rear wall to generally align the two plates of the pair with the two ends of a respective one of the lower channel members 82*b*. Each top plate 86*b* features a horizontal through hole 90*b* aligning with that of the other top plates. This second set of connectors is thus cooperable with the quick attach unit of FIG. 3A when the bucket is inverted, by inserting the upper edges 76*a* of the main plates 76 of the quick attach unit into the second set of channel members 82*b* and then pinning the connection plates 78 to the second set of plates 86*b* of the bucket. In the illustrated embodiment, a blocking plate closes off each end of each channel member to block lateral sliding of the bucket, and one blocking plate of each channel forms one of the hole-equipped plates for the other set of connectors. One set of connectors is thus laterally adjacent the other along the rear wall of the bucket, with the two sets of connectors occupying the same plane adjacent and parallel to the rear wall, and the relative positioning of the two connector types in each connector set being inverted relative to the other connector set.

Figure 4B:
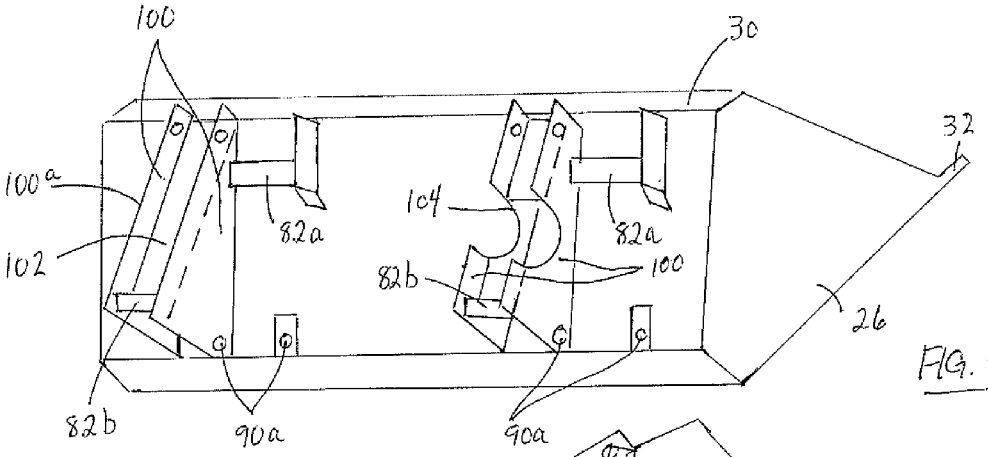
FIG. 4B is a rear perspective view of a variant of the invertible bucket of FIG. 4A, in which different sets of connection elements for attaching the bucket in standard forward-mode and inversed, rearward-mode orientations are positioned in different planes for optimal performance.
Figure 4C:
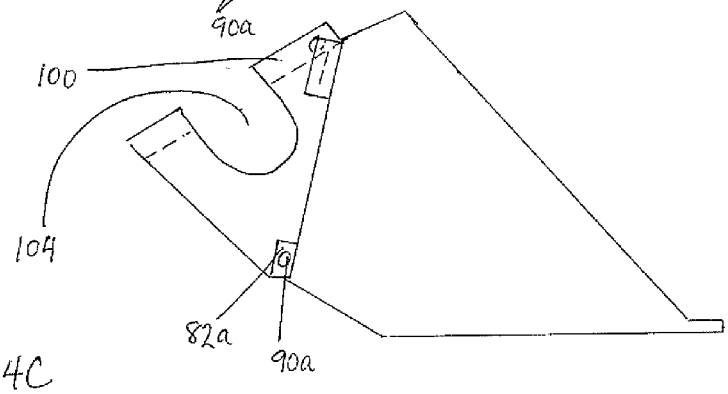
FIG. 4C is a side elevational view of the invertible bucket of FIG. 4B.

FIGS. 4B and 4C show a variant of the bucket attachment of FIG. 4A, in which the second set of connectors are not positioned in the same plane as the first set, instead residing in a different plane that is obliquely oriented relative to the rear wall of the bucket to position the upward-opening lower channel members 82*b* further outward from the bucket's rear wall than the pin-holes of same connector set. To accomplish this, two pairs of plates 100 of tapered shape, e.g. triangular or substantially triangular, are fixed to the rear wall to project perpendicularly therefrom, the two triangular plates 100 of each pair residing at the two ends of a respective one of the lower channel members, which is then fixed in place between the triangular plates 100 near the point thereof furtherest from the rear wall of the bucket near the bottom edge thereof. A rectangular plate 102 spans between the triangular plates 100 along the sloped edges 100*a* thereof than angle obliquely downward away from the rear wall from proximate the top edge thereof. The rectangular plate 102 is offset a short distance inward from these sloped edges of the triangular plates to reside between these edges and the rear wall of the bucket, and the respective channel member 82*b* cooperates with the rectangular plate 102 to form the upward facing slot that engages downward over the top of the quick attach unit when the bucket is installed in the inverted position. One triangular plate of each pair forms one of the pin-hole equipped plates of the other set of quick-attach connectors on the bucket.

As the lateral distance between the two channels of each connection set must be equal among the two sets so that each connection set will properly fit the lift-arm spacing of the working machine in question, one pair of triangular plates in the angularly offset second connector set thus resides between the two lift arm connectors of the first set. In order to accommodate the cross-member(s) of the quick attach unit when it is connected to the first set of connectors on the bucket, this inner pair of triangular plates 100 and respective rectangular plate 102 feature a central cutaway portion 104 between its two ends, where the otherwise generally triangular plates of this pair are cut into from the downward sloping edge 100*a*. It will be appreciated that arrangements other than use of triangular or otherwise tapered bracket shapes may be used to mount the channels of the second connector set at a distance further outward from the rear of the bucket than the corresponding pin-hole connectors of the same set, for example by independently supporting the two connector types of that set by separate members that leave space between them along the rear of the bucket to accommodate the cross-member(s) of the quick-attach unit. The described angling of the plane of the second connectors out of parallel alignment with the first connectors and rear wall of the bucket serves the aforementioned purpose of the tapered shape of the bucket bracket of FIG. 2, by orienting the rear wall of the bucket in a manner sloping forwardly away from the quick attach unit of the working machine when the actuators on the lift arms are retracted so that the opening of the inverted bucket opens in a downward and more rearward direction suitable for initially cutting into the ground but so better suited to deliver the ability to arrive at the preferred upward facing more horizontal limit of its rotation.

Although the second set of connectors in FIG. 4B/4C is in a different plane than the first set, the relative positioning of the different connector types (channel/slot vs. pin-hole) is still inverted between the two connector sets. In the first connector set, the channel/slot connectors are nearer the top edge of the bucket's rear wall than the pin-hole connectors, while in the second set, the pin-hole connectors are nearer the top edge of the rear wall than the channel-slot connectors. Thus the non-coplanar configuration of the different connector sets changes the orientation of the rear wall of the bucket relative to the quick-attach unit, while switching between the two connector sets still acts to generally invert the orientation of the bucket by switching the general direction in which the bucket opens.

Figure 5A:
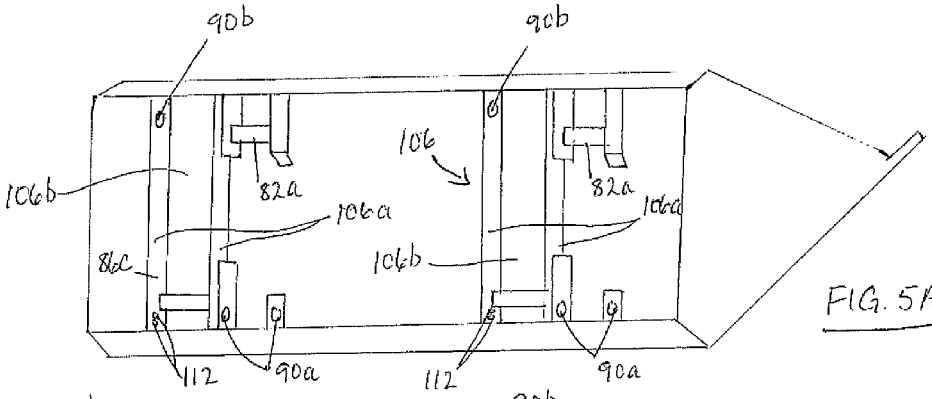
FIGS. 5A and 5B are rear perspective views of a fourth embodiment invertible bucket for a conventional skid steer of the type employing the quick attach system of FIG. 3A.
Figure 5B:
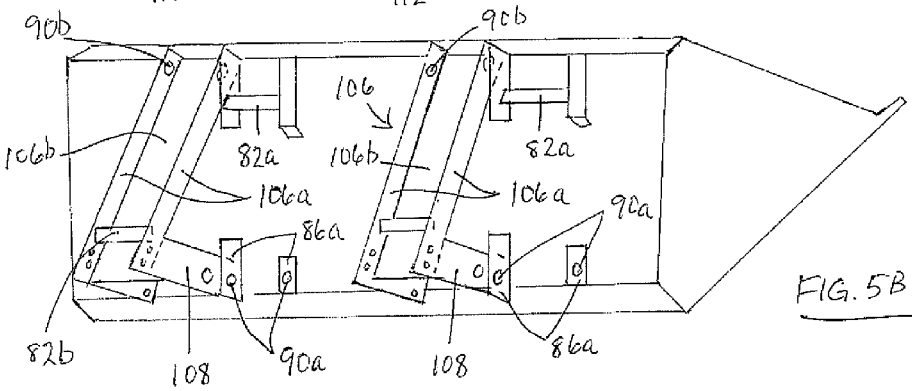
Figure 5C:
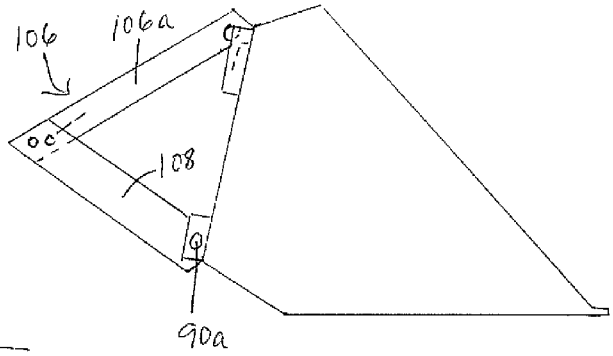
FIG. 5C is a side elevational view of the invertible bucket of FIGS. 5A/5B.

FIG. 5 shows a fourth embodiment that provides the functionality of both bucket attachments of FIG. 4 within a single unit. The first set of connectors is generally the same as for FIG. 4A, featuring downward-opening upper channel members fixed to the rear wall near the upper edge thereof between blocking plates, and featuring hole-equipped paired plates near the bottom edge of the rear wall in alignment with the blocking plates. However, the plates in which the pin-holes of the second set of connectors are formed are neither the small fixed plates of FIG. 4A, nor the triangular plates of FIGS. 4B and 4C. Instead, the pin-holes 90*b* of the second connector set are provided in side walls of pivotal U-shaped channels 106 that open away from the bucket's rear wall and are hinged to the bucket at the top of the rear wall 24 thereof in order to be swingable out of and back into a stowed position (FIG. 5A) in which the U-shaped channels lie against the rear wall of the bucket with their side-walls in general alignment with the fixed blocking plates and pin-hole plates 86*a* of the first set of connectors. Each lower upward-opening channel 82*b* of the second set of connectors is fixed in place between the side walls 106*a* of the respective U-shaped channel 106 near the end thereof furthest from the hinged connection to the bucket to define a respective slot between the upward-opening channel 82*b* and the central wall 106*b* of the U-shaped channel.

In the stowed, or alternately the lowest, position of FIG. 5A, the U-shaped channels 106 place the second set of connection features in the same positions as the embodiment of FIG. 4A, thus providing the same functionality thereof. However, with reference to FIGS. 5B and 5C, swinging the U-shaped channels outward from the rear wall of the bucket and locking them in such a position with releaseably attachable linking members 108 allows the second set of connection features to be set in a plane different from the first set of connectors in order to optimize the orientation of the bucket relative to the quick attach system for inverse operations. In the illustrated embodiment, each linking member 108 is an elongated plate having multiple pairs of bolt-holes 110 extending through it at spaced positions along the length of the member starting from near one end of the member. A single pair of bolt holes 112 is also provided in each side wall 106*a* of the U-shaped channels 106 near the ends thereof opposite their hinged connections to the bucket. At the opposite end of each of the linking members 108, a single through-hole is placed in alignment with the pin-holes 90*a* of the first connection set on a respective side of one of one of the U-shaped channels so that the linking member can be fastened to the rear wall of the bucket at these aligned holes. Pivoting of the linking member about the axis of these aligned holes and pivoting of the respective U-shaped channel 106 about its hinge axis is performed in order to align the bolt holes in the respective side wall of the U-shaped channels with a selected pair of bolts holes in the linking member, whereby the linking member can be bolted to the U-shaped channel member to lock-in the position thereof corresponding to the selected bolt-hole pair in the linking member. Each U-shaped channel is preferably secured in this manner on both sides by employment of two linking members per U-shaped channel. Therefore, on the side of each U-shaped channel 106 opposite the plates 86*a* of the first connector set, a plate 86*c* identical to the nearest plate of the first connector set features provides additional pin-hole 90*c* that aligns with the pin-holes 90*a* of the first connection set. Each side wall of each U-shaped channel features an additional pair of bolt holes that align with a respective pair of bolt holes in the bucket mounted plates 86*a*, 86*c* when the U-shaped channels are stowed to allow secure fastening thereof in this position.

By providing multiple points along the linking member at which the U-shaped channel can be attached, the user can select among a plurality of possible planes for the second set of connection features relative to the plane of the first set of connection features and the rear wall of the bucket. Accordingly, the user can select a particular operational orientation of the bucket best suited for the user's particular machine or the particular task to be performed with the inverted bucket. It will be appreciated that linking members may be arranged to remain fastened to the bucket in a pivotal manner at all time, and simply fold up into a stowed position alongside the U-shaped channels when not in use.

The embodiments of FIGS. 4 and 5 thus provide solutions for gaining invertibility and changeable rotational field by means of a fixed receiving structure suited to couple with the loader's particular universal quick-attach male couplers.

Figure 6A:
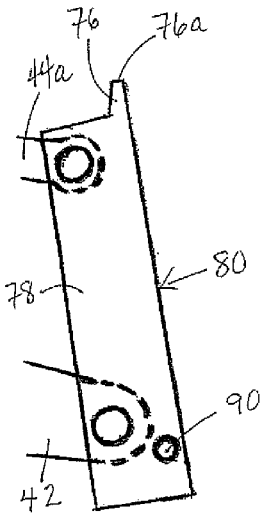
FIG. 6A is a side elevational view of a fifth embodiment inverting bracket for inverting a prior art bucket of a conventional skid steer loader of the type employing the quick attach system of FIG. 3A, thereby enabling use of the bucket in the rearward-digging-mode orientation.

FIG. 6A shows a fifth embodiment bracket 120 that can be used to connect a conventional loader bucket to quick attach unit of the type shown in FIG. 3A in an inverted position. The bracket 120 has a frame work comprising three channel members of U-shaped section, which are interconnected generally end-to-end in a substantially triangular configuration. The central span of a first channel member 122 has a width between the side walls 124 of the channel that slightly exceeds the width of each main plate 76 of the quick-attach unit. At an upper end of the first channel 122, a smaller L-shaped channel 126 is fixed to the central span of the first channel member to extend thereacross, and project outward therefrom then downward therealong between the first channel's side walls 124 to form a downwardly opening slot between the downward depending leg of the smaller channel 126 and the central span of the first U-shaped channel member on the outside of the triangular frame. Near the bottom end of the first U-shaped channel member 122, a transverse through-hole 128 extends horizontally through its side walls 124. The first channel member 122 is thus attachable to the quick-attach unit in a conventional manner, by receiving the top edge 76*a* of one of the main plates 76 of the quick-attach unit in the downward opening slot and then aligning the holes in the quick attach unit and the first channel member to pin the lower end of the connection plates at that end of the quick attach unit to the side walls of the first channel member.

The second channel member 130 extends from the top end of the first channel member 122, and the third channel member 132 is fixed to the opposite end of the second channel member 130 and extends back toward the bottom end of the first channel member. The third channel member has the form of one of the main plates and associated connection plate of the quick-attach system, but in an inverted orientation and minus the holes for pinned connection to the working machine lift arms and attachment manipulation actuators. That is, the third channel member 132 presents a projecting feature at the bottom end thereof in the form of a lower portion 134 of its central span that extends further downward than the side walls of the channel to situate the bottom edge 134*a* of this central span at a distance beyond the bottom of the rest of the channel member, and also features a pair of aligned holes 136 in the side walls of the third channel member near the connection to second channel member near the top of the third channel member. A gusset 138 interconnects the outwardly opening first channel member to the inwardly opening third channel member of the nearly triangular frame.

The first channel member 122 defines a rear end of the frame configured for connection to the quick attach unit 80, and the third channel member 124 defines a front end of the frame that is configured for connection to an inverted bucket and oriented in a manner tilting forward about its bottom end relative to the rear end of the frame. That is, the rear of the frame has a slot-type connection feature at its top for engagement with the projection feature at the top of the quick attach unit and a pin-hole connection feature at its bottom end for pinned engagement with the corresponding pin hole near the bottom of the quick attach unit, while the front of the frame has a projection feature at its bottom for engagement with the slot-type connection feature of a conventional bucket and a pin-hole feature near its top for engagement with the pin-hole connection feature of the bucket. Connection of the bucket to the bracket thus requires inverting the bucket, while the downward tapering shape of the triangular frame of the bracket positions the rear end of the bucket opening at a location near the pivotal connection of the bracket to the quick-attach unit while tilting the inverted bucket in a direction orienting its opening in a direction facing downward and rearward. The bracket thus converts a conventional loader bucket into a rearward facing implement. A separate individual bracket may be used at each lift arm of the machine, or two brackets, each for a respective lift arm of the machine, may be combined into a single unit by one or more cross-members joining the two brackets.

Figure 6B:
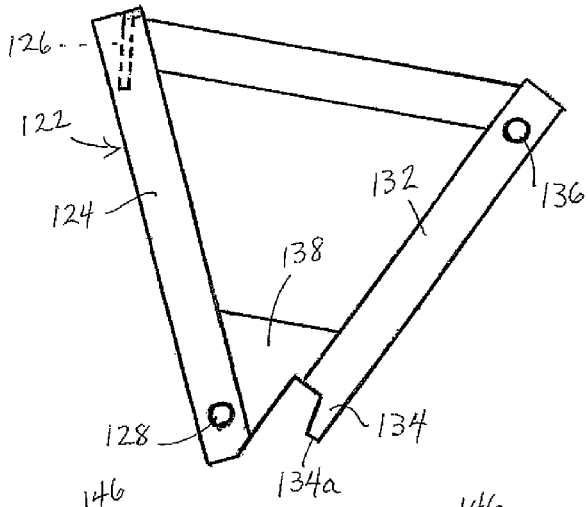
FIG. 6B is a side elevational view of an adjustable variant of the fifth embodiment inverting bracket in a partially collapsed state positioning front and rear ends of the bracket at a relatively small oblique angle relative to one another.
Figure 6B:
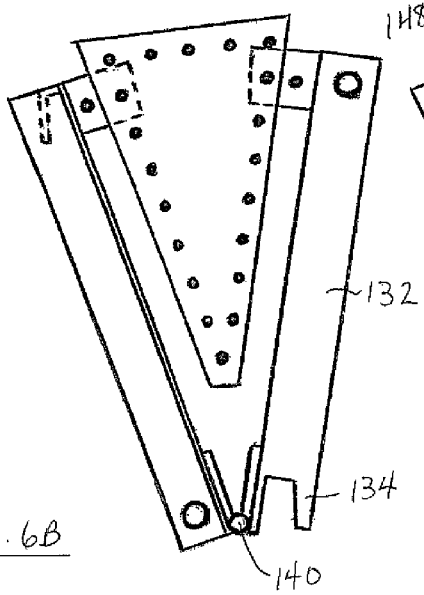
Figure 6C:
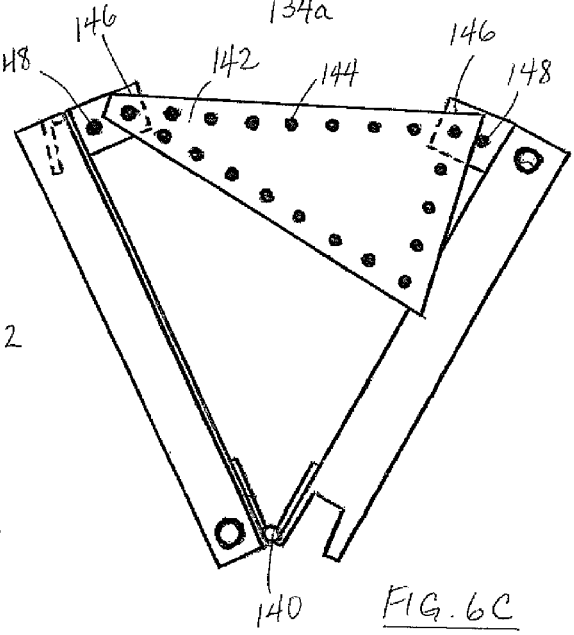
FIG. 6C is a side elevational view of the adjustable inverting bracket of FIG. 6B in a fully extended state having a greater angle of separation between the front and rear ends of the bracket.

FIGS. 6B and 6C show a variation of the bracket of FIG. 6A, where rather than fixed rigid connection of all three channel members by gusset 138, the front and rear channel members 132', 122 are interconnected by a hinge 140 to allow pivoting of these members relative to one another. The second channel member is replaced by a pair of linking members 142 having multiple holes 144 therein via which the linking members 142 can be fastened between the channel members 122, 132' near the top ends thereof. For this purpose, short jutting plates 146 project perpendicularly from the two channel members 122, 132' at the top ends thereof, each in a direction extending toward the other channel member. Each jutting plate 146 has at least one hole 148 therein for fastening of the linking member 142 to the jutting plate by alignment of holes in these pieces and engagement of a fastening device through the aligned holes.

The linking member 142 of the illustrated embodiment is a plate having the shape of a slightly truncated triangle, that if not truncated would have one side shorter than the other two, so as to have a wider end narrowing toward an opposing narrower end. In the illustrated embodiment, the two longest sides are of equal length (i.e. truncated isosceles triangle). The holes in the linking member are arranged in a series following around the periphery of the plate a short distance inward therefrom. This allows fastening of the channel members and linking member into a number of closed triangular shapes of varying angles without having the linking member project outward past either the front or rear end of the frame.

For example, with reference to FIG. 6B, selection of fastening holes adjacent opposing ones of the longest sides of the linking member 142 near the next-longest side provides a greater angle of divergence between the U-shaped channel members 122, 132' than selection of holes along those same sides closer to the truncated tip (i.e. narrow end, or shortest side) of the linking member. On the other hand, referring to FIG. 6C, using fastening holes near opposite ones of the shortest and second shortest sides of the linking member increases the angle between the linking members. The bracket is thus adjustable to give the user control over the angle between the quick-attach unit of the working machine and the rear wall of the bucket to be used in an inverted digging position. FIGS. 6B and 6C also illustrates that the bottom end of the front of the frame can be modified from what was described for FIG. 6A while still providing a suitable downward projecting feature 134 for engaging the slot-type connection feature of the quick-attach bucket.

The embodiments of FIG. 6 thus provide separate and distinct (from the bucket) autonomous devices that provide invertibility of the bucket, and changeable rotational field or range of the bucket by adjustment of the angle between the bucket's opening and its connection to the attachment features of the work machine. In these embodiments the devices each serve as an intermediary between the lift arms and the respective attachment, coupling with them via their respective male/female quick-attach couplers.

Figure 7:
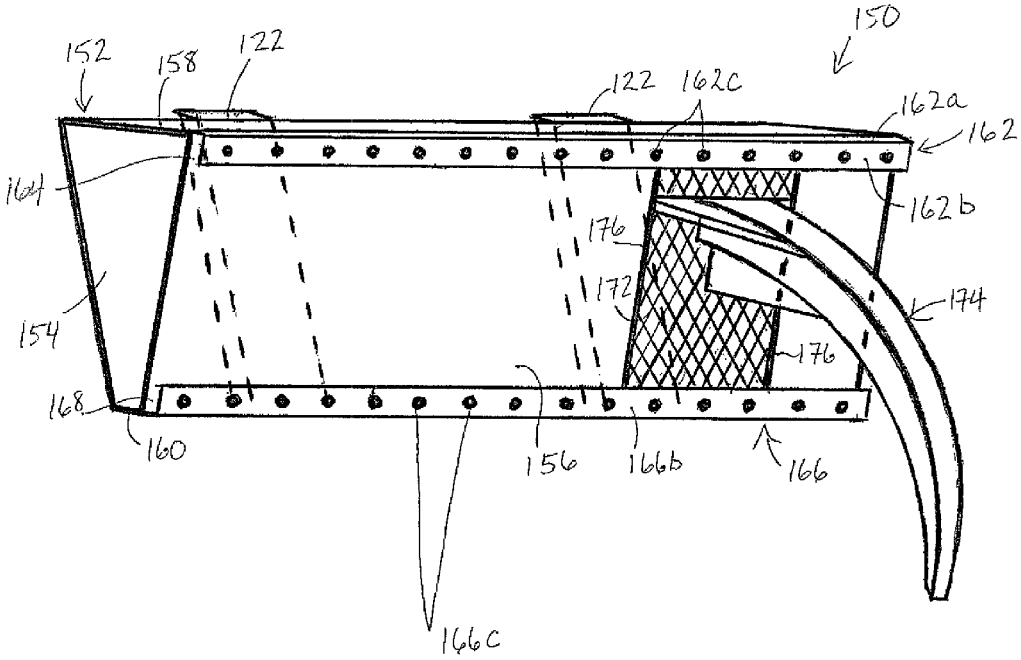
FIG. 7 is a front perspective view showing use of a tooth implement in a sixth embodiment invertible implement system of the present invention designed to enable both inversion and lateral-position adjustment of the tooth implement.

FIG. 7 shows an invertible-implement system 150 that can be used not only to mount a bucket or other implement in two different orientations, each inverted relative to the other, but also to allow repositioning of the implement in a lateral direction transverse to the working machine's longitudinal axis. FIGS. 7 and 8 shows the system being employed to support a curved-tooth implement, while FIG. 9 illustrates use of the system for invertible, laterally adjustable support of a bucket implement.

The system 150 features a frame 152 that, like the bracket of FIG. 5A, has tapered shape in a vertical cross-sectional plane, such as that defining a central longitudinal plane of the working machine at a central location between the working vertical planes of the lift arms. The skeleton of the frame features four plates connected together end-to-end to define respective sides of a box beam having a tapered cross-sectional shape. A rear plate 154 defines the rear end of the frame, a front plate 156 lies opposite the rear plate 154 to define the front end of the frame, a top plate 158 interconnects the top ends of the front and rear plates to define the wider upper end of the frame, and a bottom plate 160 defines the smallest side by interconnecting the bottom ends of the front and rear plates in a position opposite the top plate to define the narrow bottom end of the frame 152.

On the rear plate 154 of the frame 152, two channel members 122 of the same type described for the first member of the FIG. 6A bracket are fixed to the rear-facing outer side of the rear plate 154 to extend along the plane of the rear from near the top plate to near the bottom plate. The central span or wall of each channel member 122 is fixed to the rear plate 154 so that the channel member opens away from the rear plate to allow access to the downward-opening slot defined near the upper end of the channel member by the smaller channel piece fixed to the central span thereof for engagement by the projecting upper edge 76*a* of the quick attach unit 80 of the working machine. The side walls of each channel member 122 feature aligned through-holes 128 near their bottom ends as described for FIG. 6A for pinning to the connection plate 78 of the quick attach unit 80. The frame 152 can thus be carried by the lift arms and actuators of the working machine through coupling of the quick attach unit 80 to these connection features carried at the rear end of the frame 152.

An upper right angle channel 162 fixed to the frame 152 extends along the top edge of the front plate 156, a first leg 162*a* of the right angle channel 162 jutting forwardingly away from the front face of the front plate 156, and a second leg 162*b* of the right angle channel 162 depending downward from the first leg along the outer front face of the front plate 156 at a short distance therefrom. The upper right angle channel 162 thus defines a downwardly-opening slot 164 between its second leg 162*b* and the opposing front face of the front plate 156. Spaced along the length of the upper channel 162, which runs the full length of the front plate 156 in the illustrated embodiment, is a first series of through holes 162*c* that extend through its second leg 162*b* toward and through the front plate 156 thereopposite.

A lower right angle channel 166 fixed to the frame 152 extends along the bottom edge of the front plate 156, a first leg 166*a* of the right angle channel 166 jutting forwardingly away from the front face of the front plate 156, and a second leg 166*b* of the right angle channel 166 depending upward from the first leg along the outer front face of the front plate 156 at a short distance therefrom. The lower right angle channel 166 thus defines an upwardly-opening slot 168 between its second leg 166*b* and the opposing front face of the front plate 156. Spaced along the length of the lower channel 166, which runs the full length of the front plate 156 in the illustrated embodiment, is a second series of through holes 166*c* that extend through its second leg 166*b* toward and through the front plate 156 thereopposite.

An implement 170 of the system features a base portion 172 in the form of a flat rectangular plate 1, and a working portion 174 defining the ground working feature of the implement. The width of the two slots 164, 168 defined by the upper and lower right angle channels 162, 166 at the front end of the frame each slightly exceed the thickness of the base plate 172 of the implement. Two parallel side edges 176 of the base plate have an equal length that is longer than the distance between the second legs 162*b*, 166*b* of the upper and lower right angle channels 162, 164, and just slightly shorter than the distance between the distance between the first legs 162*a*, 166*a* of the upper and lower right angle channels 162, 164.

With each right angle channel member 162, 166 being open-ended at both ends, the separate implement 170 is thus mountable on the frame 152 by inserting the top and bottom edges 178*a*, 178*b* of the base plate 172 of the implement 170 into the slots 164, 168 of the two right angle channels 162, 164 at a selected end of the frame 152.

The seating of the straight bottom edge of the base plate 172 on the first leg 166*a* of the lower right angle channel 166 forms a sliding interface between the implement 170 and the frame 152, whereby the implement 170 can be slid along the front face of the frame between the ends thereof to adjust the lateral position of the implement on the frame. A first series of holes in the base plate 172 of the implement 170 are spaced along the top edge thereof, with inter-hole spacing matching the inter-hole spacing of the two series of holes 162*c*, 166*c* at the top and bottom right angle channels 162, 166 of the frame 152. Likewise, a second series of holes in the base plate 172 of the implement 170 are spaced along the bottom edge thereof, with inter-hole spacing matching the inter-hole spacing of the two series of holes 162*c*, 166*c* at the top and bottom right angle channels 162, 166 of the frame 152. The distance of each series of holes in the implement base from the respective edge of the base matches the distance of each series of holes in the right angle channels of the frame from the first leg of that respective channel member. Accordingly, the spacing apart of the two hole series of the frame matches that of the two holes series of the implement, and regardless which of the top or bottom edge 178*a*, 178*b* of the base plate 172 is placed on the bottom right-angle channel 166 of the frame 152, the holes near that edge can be aligned with the holes 166*c* in the bottom right angle channel 166 to allow pinning of the base plate 172 of the implement to the frame 152 at a selected location thereacross. Each hole in the first series 162*c* of frame holes is positioned along the frame 152 to match the position of a corresponding hole in the second series 166*c* of frame holes, and likewise each hole in one series of the holes in the implement base matches a corresponding hole in the other series along the top and bottom edges of the base. Accordingly, matching up a frame hole with an implement base hole near the top of the frame also matches up a pair of holes near the bottom of the frame, and vice versa.

Figure 8A:
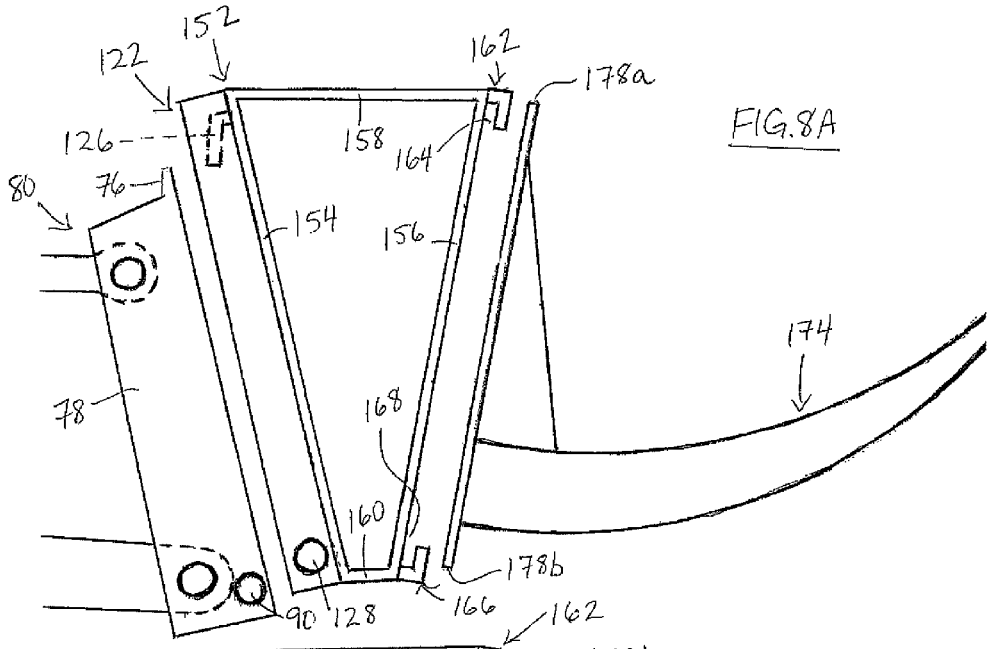
FIG. 8A is a side elevational view illustrating installation of the tooth of FIG. 7 in an upwardly curving orientation in the sixth embodiment invertible implement system.
Figure 8B:
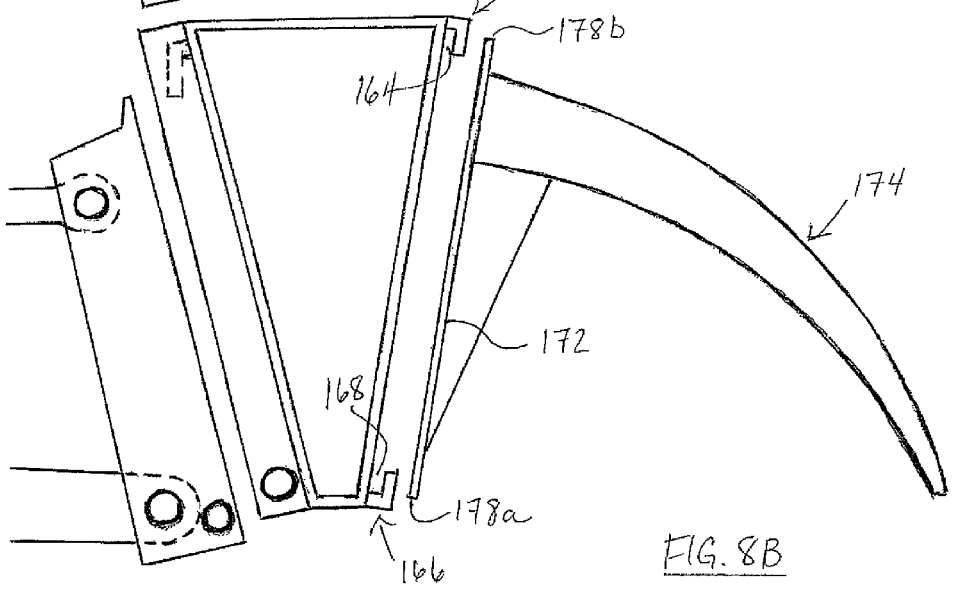
FIG. 8B is a side elevational view illustrating installation of the tooth of FIG. 7 in a downwardly curving orientation in the sixth embodiment invertible implement system.

Fixed to a front face of the base 172 that faces away from the front of the frame 152 is the working portion 174 of the implement, which in FIGS. 7 and 8 is a curved tooth. FIG. 8A shows the implement base 172 in a first upright orientation corresponding to engagement of its upper edge 178*a* into the slot 164 of the upper right angle channel 162 of the frame and engagement of its bottom edge 178*b* into the slot 168 of the lower right angle channel 166 of the frame 152. In this orientation, the tooth curves upwardly moving away from the base plate 172, for example for use in a pavement removal operation in which the tooth is used to penetrate under the material for subsequent lifting through rotation and raising of the working vehicle's lift arms. FIG. 8B shows the implement base 172 in a second inverted orientation corresponding to engagement of its bottom edge 178*b* into the slot 164 of the upper right angle channel 162 of the frame and engagement of its top edge 178*a* into the slot 168 of the lower right angle channel 166 of the frame 152. In this orientation, the tooth curves downwardly moving away from the base plate 172, for example for use in a ground-picking operation in which the tooth is be engaged into the ground through lowering of the lift arm, tilting of the quick attach unit 80, or a combination thereof.

It will be appreciated that the base 172 of the implement may be of shapes or configurations other than a purely flat plate while still providing top and bottom edges of suitable size and shape for receipt in the channel members on the front face of the frame for sliding of the implement back and forth therealong.

Figures 9A, 9B:
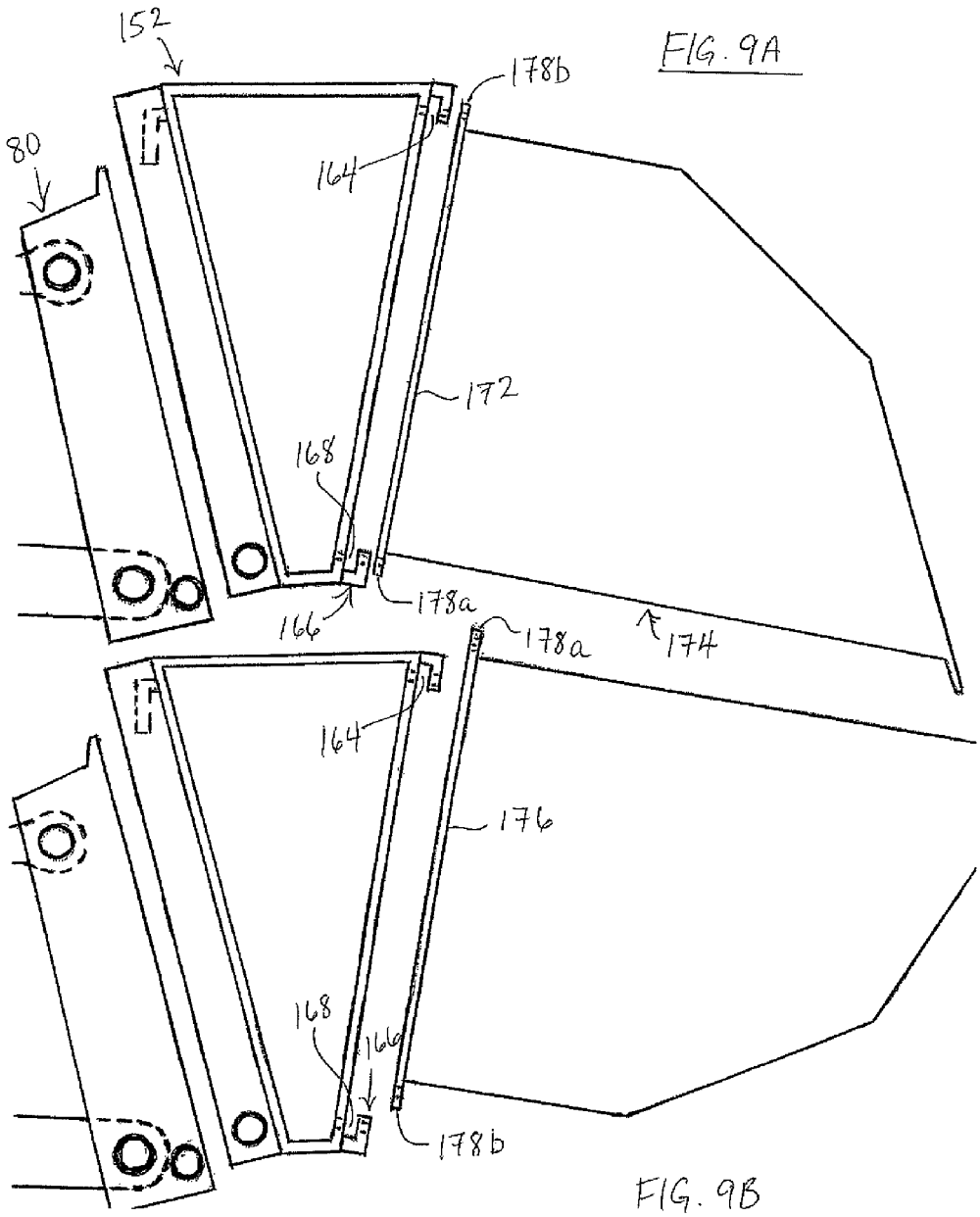
FIG. 9A is a side elevational view illustrating installation of a bucket for digging-mode operation in the sixth embodiment invertible implement system of FIG. 7.
FIG. 9B is a side elevational view illustrating installation of the bucket of FIG. 8A for loader-mode operation in the sixth embodiment invertible implement system of FIG. 7.

FIG. 9 illustrates similar use of the laterally adjustable implement system 150 to carry a bucket-type implement having a base plate 172 sized for sliding receipt between the right-angle channels of the frame 152. With reference to FIG. 9B, the top edge 178*a* of the base plate 172 extends upwardly past the opening of the illustrated bucket when in the upright loading position, while the bottom of the bucket extends past the bottom edge 178*b* of the base plate 172, but leaves a gap between the base plate and lowermost portion of the bucket's rear wall for accommodating the second leg 166*b* of the lower right angle channel 166 of the frame 152. The base plate itself may form the remaining upper portion of the bucket's rear wall in this configuration. Other arrangements of the base plate's top and lower edges relative to features of the bucket may of course be implemented while still providing the lateral adjustability of the bucket's position across the front of the frame.

Referring again to FIG. 7, while the base plate preferably includes multiple pin holes near each of its top and bottom edges to allow multiple pinned connections per edge for secure attachment of the implement, as few as one hole per such edge would still allow for connection to the frame. For the small base plate of FIG. 7, which occupies only part of the frame's width between the ends of the front plate 156, use of multiple holes along one or both of the channel members provides for a high level of lateral adjustability of the implement For a larger implement, for example a bucket having a larger base plate, for example one that has a width substantially equaling that of the frame, one could instead have as few as one hole in the channel's of the frame cooperable with several holes in the implement base to still allow some lateral adjustment of the implement. While the illustrated embodiment features top and bottom holes on both the frame and the implement base, having two hole sites (top and bottom) on one of the frame or implement base and one hole site (top or bottom) on the other would still allow connection between the two at one end of the implement base.

With open or openable ends of the channels on the frame, implements may be adjusted to positions overhanging beyond an end of the frame, or an implement wider than the frame may be used. The system also demonstrates a way of attaching implements in regular and inverted positions, even if the use of multiple selectable connection sites (e.g. series of pin-holes) are not used to allow lateral adjustability of the implement position. Instead of open-ended channels into which the implement base can be slid, the frame may employ other configurations, for example having a fixed bottom channel and a hinged top channel, whereby the top channel can be flipped up over the top plate of the frame to allow seating of the implement base plate into the slot of the lower channel from above, after which the top channel can be flipped down over the top edge of the implement base and locked in such position to secure the implement in place. However, the use of fixed channels is preferred for safer and stronger load handling.

While the illustrated embodiment of the invertible and laterally adjustable implement system employ pin holes at the channels that the implement slides along, it will be appreciated that the connection of the implement to the frame may occur at other locations. For example, with reference to FIG. 7, there may alternatively be pin holes in an area of the front plate 156 left exposed between the upper and lower channel members. In such an embodiment, placing a series of pin holes in a single row along the length of the frame at a central position midway between the two channels could allow attachment with one or more series of pin holes midway along the height of the base plate in both each of the two orientations of the implement. However, use of two or more sets of connection points spaced over the height of the implement is likely to provide a stronger connection with higher levels of implement stability and safety.

FIG. 10 shows a variation of the system of FIGS. 7 to 9, which adds angular adjustability between the front and rear plates of the frame. This adjustability is provided by replacing the fixed bottom plate of the frame of FIGS. 7 to 9 with a hinging feature 180 interconnecting the bottom edges of the front and rear plates 154', 156', and replacing the fixed top plate of the frame with an arcuate plate 182 spanning over the top ends of the front and rear plates for selectable fastening to in-turned flanges 184, 186 at the top ends thereof through different ones of a series of holes 188 spaced between front and rear edges 182*a*, 182*b* of the arcuate plate 182. Accordingly, angular adjustability between the front and rear ends of the frame (i.e. between the plane of connection to the working machine and the plane of connection to the working implement) can be adjusted, for example for reasons set out herein above for other embodiments, by disconnecting the arcuate plate 182 from one or both of the front and rear plates 154', 156', pivoting the front and rear plates relative to one another about the axis of the hinge 180, and then resecuring the arucate plate to the front and rear plates using fasteners 190 to secure them in this selected position relative to one another. The arcuate plate may include multiple rows of fastener holes 188 at different positions across the frame, each row corresponding to a corresponding pair of holes in the flanges 184, 186 of the front and rear plates of the frame. The layout of each row of holes between the front and rear edges of the arcuate plate matches the other rows, whereby aligning a select pair of holes in any one row with the respective pair of holes in the flanges 184, 186 likewise aligns a corresponding pair of holes in each other row with a respective pair of holes at another location along the flanges.

Instead of the arcuately curved plate over the top of the angularly adjustable frame, an alternative would be to use a flat plate linking member like that of FIGS. 6B and 6C at each end of the adjustable frame construction of FIG. 10 to temporarily fix the front and rear plates of the frame at a selected angle relative to one another. These are only examples, and other mechanisms for locking together the front and rear end of the frame at a selected angle may alternatively be employed.

FIG. 11 shows a further variant of the embodiment of FIG. 10, which adds a mechanism for adjusting the lateral position of the implement across the front of the frame. A hydraulic motor 200 is mounted on a rear side of the front plate 156' of the frame, with a rotational output shaft 202 of the motor extending along the front plate 156' in a direction parallel to the ends thereof. A drive sprocket 204 is fixed on the output shaft 202 to rotate therewith in a plane perpendicular to the shaft. Adjacent each end of the front plate 156' of the frame, a respective idler sprocket 206 is rotatably supported on the frame in the same plane as the drive sprocket at a location between the top and bottom right angle channels 162, 166 of the front plate along the plane thereof. The rotational axis of each idler sprocket lies in or adjacent the plane of the front plate 156' of the frame so that a pair of diametrically opposite points of the sprocket lie respectively in front of and behind the plane of the front plate. A length of chain 208 has its two ends releasably connected to the base plate 172 of the implement 170 slidably engaged in the slots of the right angle channels 162, 166 of the frame at locations adjacent the opposite side edges 176 of the base plate. The chain 208 is entrained about the drive and idler sprockets such that operating the hydraulic motor to rotate the drive sprocket 204 in one direction will displace the implement in a respective direction along the front face of the front plate, while operating the motor in the other direction will displace the implement in the opposite direction along the front face of the front plate. The supply and return hoses 210 of the hydraulic motor can be coupled to the hydraulic system of the working machine to allow operation of the motor from the operator seat or cabin of the working machine, whereby an operator can change or adjust the lateral position of the implement using the existing hydraulic controls of the working machine. The implement can be inverted by detaching the ends of the chain 208 from the implement base 172, removing the implement from the front of the frame, inverting the implement, placing the inverted implement back into its laterally slidable engagement on the front of the frame, and reattaching the chain ends to the now-inverted implement base.

The use of a chain driven mechanism for the lateral movement of the implement maximizes the movable range of the implement with minimal expansion of the overall apparatus size. For comparison, use of a piston-cylinder hydraulic actuator to move the implement of FIG. 11A through a comparable range along the front of the frame from adjacent one end thereof to the other would require a piston-rod length similar to the overall frame width, which would require a long cylinder effectively doubling the width of the apparatus. While use of a hydraulically driven mechanism is preferable for compatibility with the hydraulic systems typically found on front-end loader working machines, it will be appreciated that the lateral adjustment mechanism may alternatively be powered by other means. It will be appreciated that the single chain of the illustrated embodiment may be replaced by two or more chains each connected to the implement base at a respective height along the front face of the frame to provide smoother motion of the implement along the channels.

The embodiments of FIGS. 7 to 11 provide separate and distinct (from the bucket) autonomous devices that provide invertibility, changeable rotational field, and lateral manipulation/repositioning of attachments. In these embodiments the devices each serve as an intermediary between the loader boom lift arm's coupling apparatus and attachments that are specifically outfitted with secondary coupling structure uniquely designed to engage the cooperative receiving coupling structure of the device in a way as to permit lateral migration of the attachment.

Figures 14A, 14B:
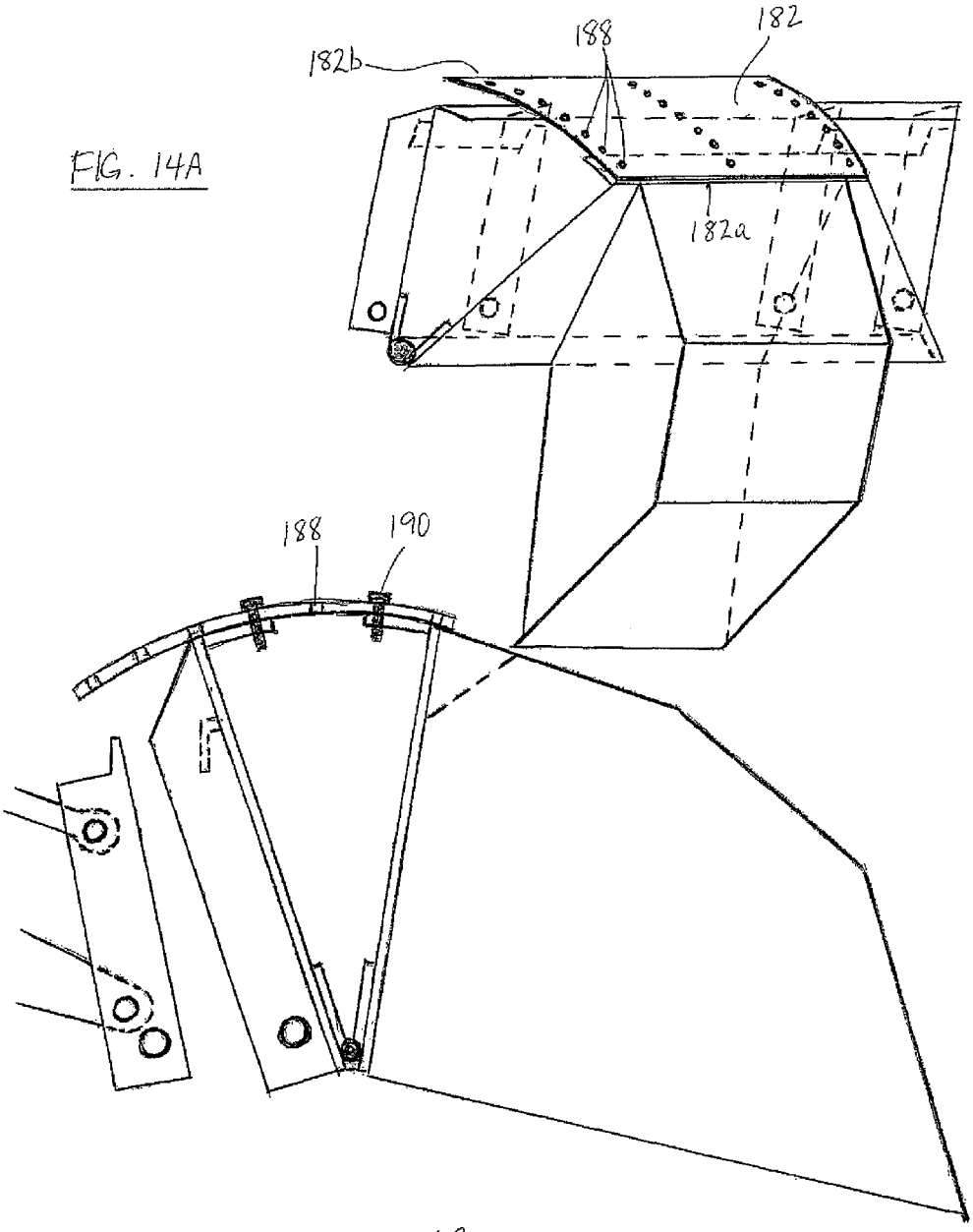
FIG. 14A is a front perspective view of a further variant of the bucket attachment of FIG. 13, featuring the addition of angular adjustability between the bucket and the quick attach system of the skid steer.
FIG. 14B is a side elevational view of the bucket attachment of FIG. 14A.

While the embodiments of FIGS. 1, 4 and 5 relate to buckets that are mountable on working machines in both regular forward orientations and inverted rearward orientations, and the embodiments of FIGS. 2 and 6 relate to brackets for mounting regular buckets in inverted rearward orientions, the embodiments to FIGS. 12 to 14 instead relate to buckets that are only mountable in downward, rear-facing orientations.

FIG. 12 shows a bucket 220 featuring a rear plate 222 having a central portion that defines a rear wall of the bucket, and two laterally outward defines on opposite sides of the central portion to span laterally outward to opposite sides of the bucket. That is, the laterally outward portions of the rear plate 222 lie outward from the side walls 224 of the bucket. The opening 226 of the bucket spans from the bottom edge 222*a* of the rear plate to the tip 228 of the bucket at the opposite end of the opening 226. A curved or segmented wall 230 joins the top edge 222*b* of the rear plate 222 to the tip 228 of the bucket along a matching curved or segmented edge of each identical side wall 224. The angle between the plane of the rear plate and a plane containing the bottom edge of the rear plate and the tip or leading edge of the bucket is an obtuse angle, so that when the rear plate of the bucket is vertical, the opening of the bucket faces downward and rearward. On a face of the rear plate facing away from the bucket, each lateral portion of the rear plate features two quadrilateral plates 232, 234 projecting perpendicularly rearward from the plane of the plate, one plate 232 at a respective end thereof and the other 234 spaced between this end and the respective side wall 224 of the bucket. With reference to the conventional quick-attach bucket features of FIG. 3, these rearward projecting plates 232, 234 feature the slot-defining downward-opening channel member 82 between their upper ends and the pin-receiving holes 88 in their lower ends. Accordingly, the rear plate 222 is engagable to a quick attach unit at its laterally outward portions. Positioning the quick attach unit in an orientation corresponding to ground-level positioning of a conventional upward and forward opening loader bucket will thus face the bucket opening of the present invention downward and rearward, making it suitable for rearward digging operations in which further forward tilting of the quick attach unit will pivot the bucket rearward in a scooping-type action. Between the inner two rearward projecting plates 234, the rear plate and attached bucket are reinforced by two pieces 236 of rectangular tubing fixed to the rear face of the rear plate at spaced apart positions near the top and bottom edges thereof respectively.

FIG. 13 shows a variant of the FIG. 12 bucket. Instead of forming the rear wall of the bucket, the rear plate 240 forms the rear wall of a four-sided box beam that is similar to the frame of FIGS. 7 to 9, except that the top and front plates 242, 244 are trapezoidal instead of rectangular. The top and front plates thus narrow as they extend toward their joined edges, below which the bucket attached to the front plate 244, thereby providing material and weight savings where the strength of a fully closed box beam structure may not be required laterally outward from the bucket. In this embodiment, it is thus the front plate 244 of the frame or box-beam that defines the rear wall of the bucket interior, and from which the bucket opening and curved or segmented wall extend to the bucket tip 228. The overall angle between the bucket opening and the quick attach unit 80 of the working machine is the same as in FIG. 12, but the angle between the bucket opening and the bucket rear wall, and thus the overall bucket size, are less than in FIG. 12.

Turning to FIG. 14, the drawings show a further variation of the embodiment of FIG. 13, in which angular adjustability of the front of the frame or box beam (i.e. the rear of the bucket) relative to the rear end of the frame or box beam has been added using the hinge and arcuate plate configuration described in detail above for the embodiment of FIG. 10. Accordingly, the bucket angle relative to the quick attach unit of the working machine can be adjusted by the owner operator to optimize the inverse-mode orientation of the bucket.

By setting the angle between the connection to the quick attach unit and the opening of the bucket, the embodiments of FIGS. 12 to 14 thus provide the rotational field adjustment deemed necessary to enable the said attachment to perform optimally in its inverse, rearward-facing configuration. As illustrated and described, this structure can exist in both fixed-angle and adjustable-angle models.

FIG. 16 shows a variant of the bracket described above with reference to FIG. 6A, particularly in form of a single-piece adapter employing two brackets rigidly interconnected by cross-members therebetween for attachment to the two lift arms of working machine as a single unit Each bracket 302 is again of a generally triangular configuration with front end that connects to an inverted bucket and a rear end of the bracket that connects to the attachment unit of a working machine. However, the type of attachment units for which the brackets are configured is not of the type shown in FIG. 3A, where transverse holes 90 in the side walls of the bracket of FIG. 6A receive a transverse pin for locking the bracket to the respective attachment unit of the working machine. Instead, the eight embodiment adapter is useful for a working machine on which the attachment units are more of the type shown in FIG. 3B, where each attachment unit has a pin movably mounted thereon for upward and downward movement between an extended position in which a lower end of the pin depends down from the attachment unit and a retracted position in which the lower end of the pin is raised up past the bottom edge of the attachment unit.

Referring to FIG. 16, at the bottom end of a base plate 304 of each bracket 302 that faces the attachment unit on the respective lift arm of the working machine, each bracket 302 is joined to the other bracket along these bottom edges of the base plates by a narrow bottom plate 306 jutting rearward from the plane shared by the base plates 304. A respective slot-shaped hole 308 passes through the bottom plate 306 at a position along the bottom edge of each base plate 304 to accommodate a locking pin of the attachment unit on the respective lift arm of the working machine.

Side walls 310 run upward from the two ends of the bottom plate 306 along upright side edges of the base plates 304 to the top edges of the base plates. The top ends of the side walls 310 are joined together by a narrow upper plate 312 that horizontally connects the side walls 310 to one another along the top edges of the base plates 304. The upper plate 312 lies in a plane that projects obliquely downward and reward from the coplanar base plates 304, thus forming the downwardly opening slot into which the top edges 76*a* of the attachment units on the lift arms of the working machine are upwardly inserted. The actuators of the working machine are used to move the attachment units into parallel orientation to the base plates 304 of the adapter brackets 302, at which point the pins on the attachment units are extended downward to deploy their bottom ends downwardly through the holes 308 in the bottom plate 306 of the adapter 300, thereby securing the adapter to the attachment units of the working machine.

The front end of each bracket 302 features a U-shaped channel member 314 lying at an oblique angle relative to the base plate 304 of the rear end of the bracket in order to define an opposing side of the bracket's generally triangular shape. A central span 314*a* of the channel member 314 faces the base plate 304, and two side walls 314*b* of the channel member 314 project toward the rear end of the bracket from side edges of the channel member's central span 314*a*. The central span of the channel member is aligned with the base plate 304 of the bracket in the transverse direction, and is equal or similar in width to the base plate, with one side wall of the channel member 314 thus lying in the same plane as the side wall 310 of the bracket's rear end, or in a parallel plane adjacent to that of the side wall 310. Like the fifth embodiment of FIG. 6A, a gusset-like structure 316 interconnects the front and rear ends of the bracket at their lower ends. A pair of braces 318 interconnect the upper extents of the front and rear ends of the bracket at the side walls 314*b* of the front end's channel member 314.

On the side of the front channel's central span 314*a* that faces toward the rear base plate 304, each bracket 302 features a length of rectangular tubing 320 that is fixed in a position running from the top end of the rear channel 314 along the inner one of the channel's side walls 314*b* nearest the other bracket 302. A locking bar 322 is telescopically received within the rectangular tubing, and a displacement mechanism

Figure 16A:
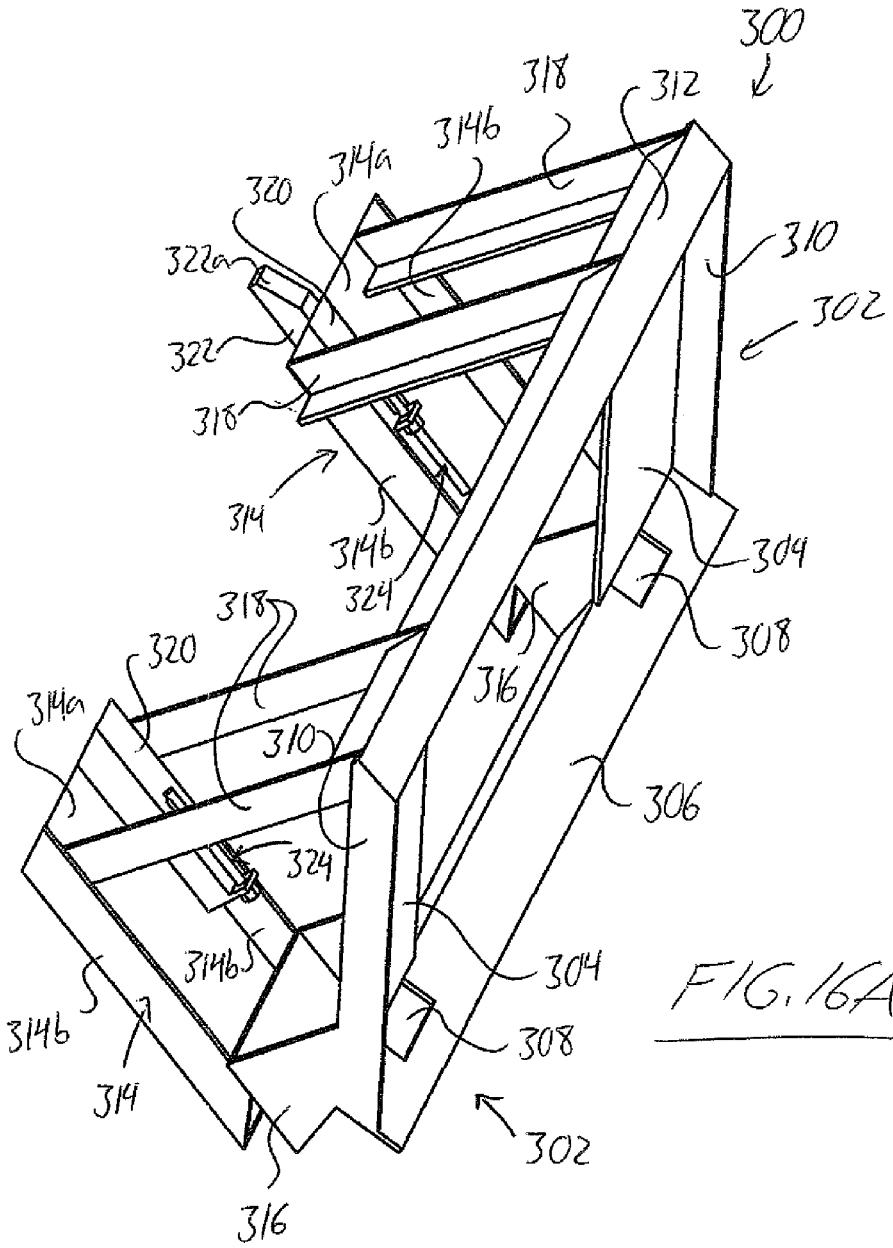
FIG. 16A is front side perspective view of an implement inverting adapter employing brackets according to a variant of those of FIG. 6A, whereby the brackets are compatible with a quick attach system of the type shown in FIG. 3B.
Figure 16B:
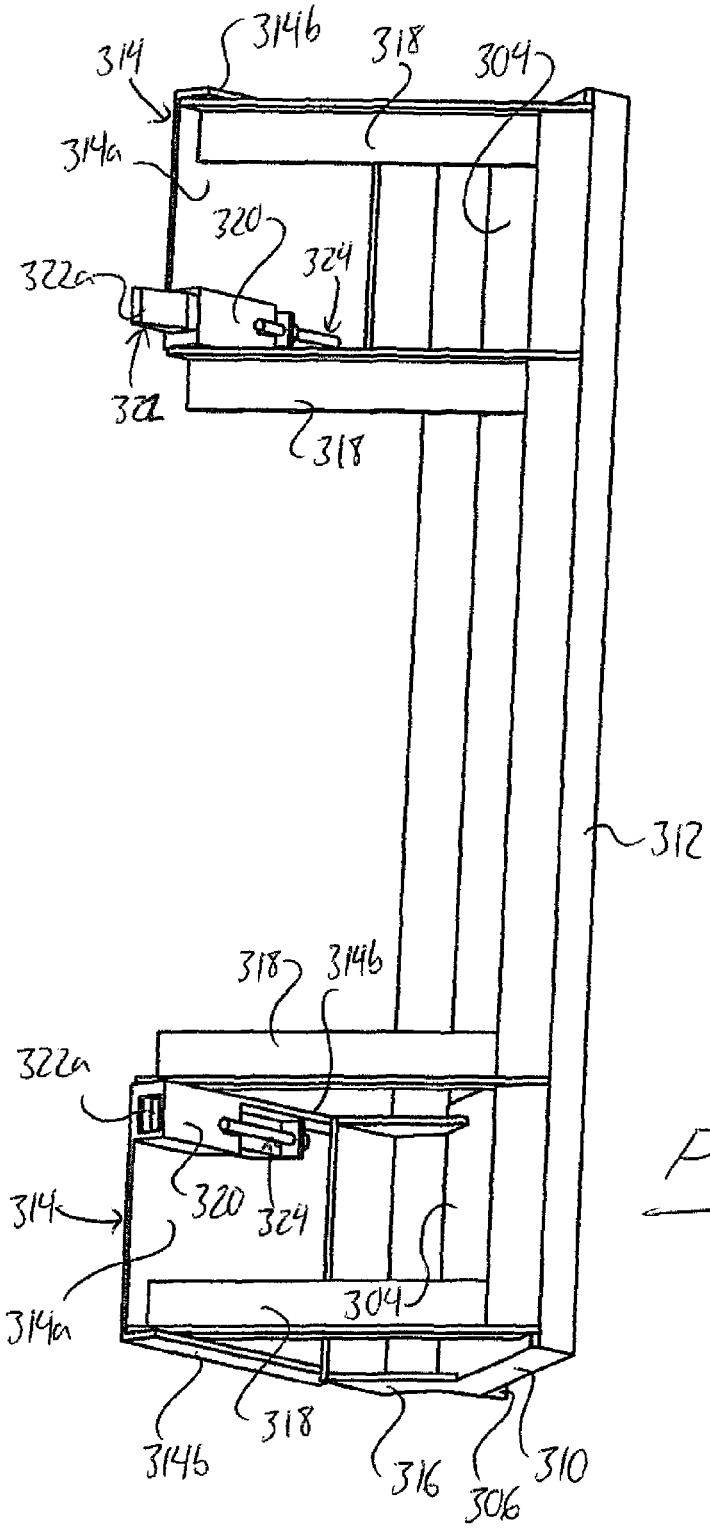
FIG. 16B is an overhead view of the implement inverting adapter of FIG. 16A.

324 is operable to displace the locking bar 322 back and forth along the tubing 320. In FIGS. 16A and 16B, the locking bar on the bracket at the top of the figure is shown in an extended position where a tapered end 322*a* projects outward from the upper end of the tubing 320, while the other locking bar on the bracket at the bottom of the figure is shown in a retracted position where the tapered end of the locking bar 322 is retracted inside the tubing.

Figure 16C:
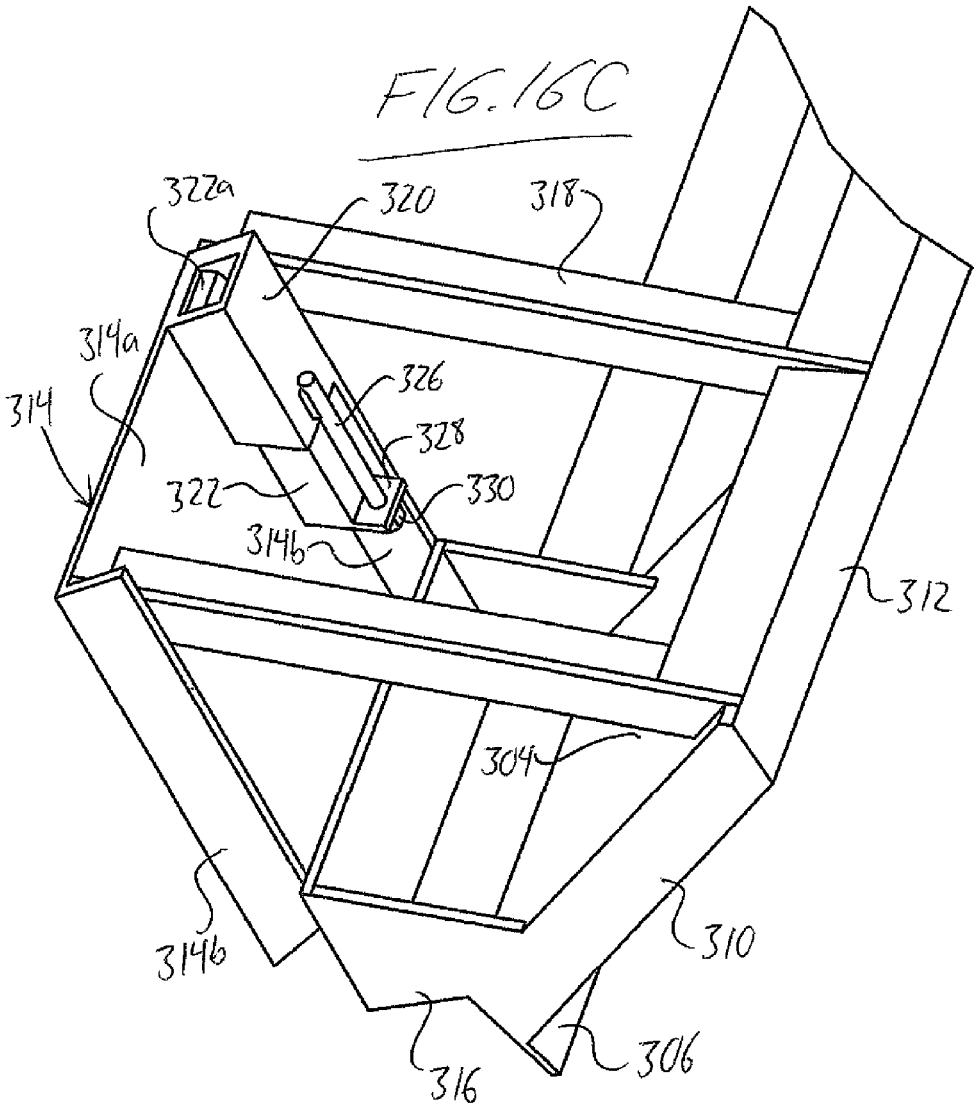
FIG. 16C is a partial top side perspective view of the implement inverting adapter of FIG. 16A.
Figure 17A:
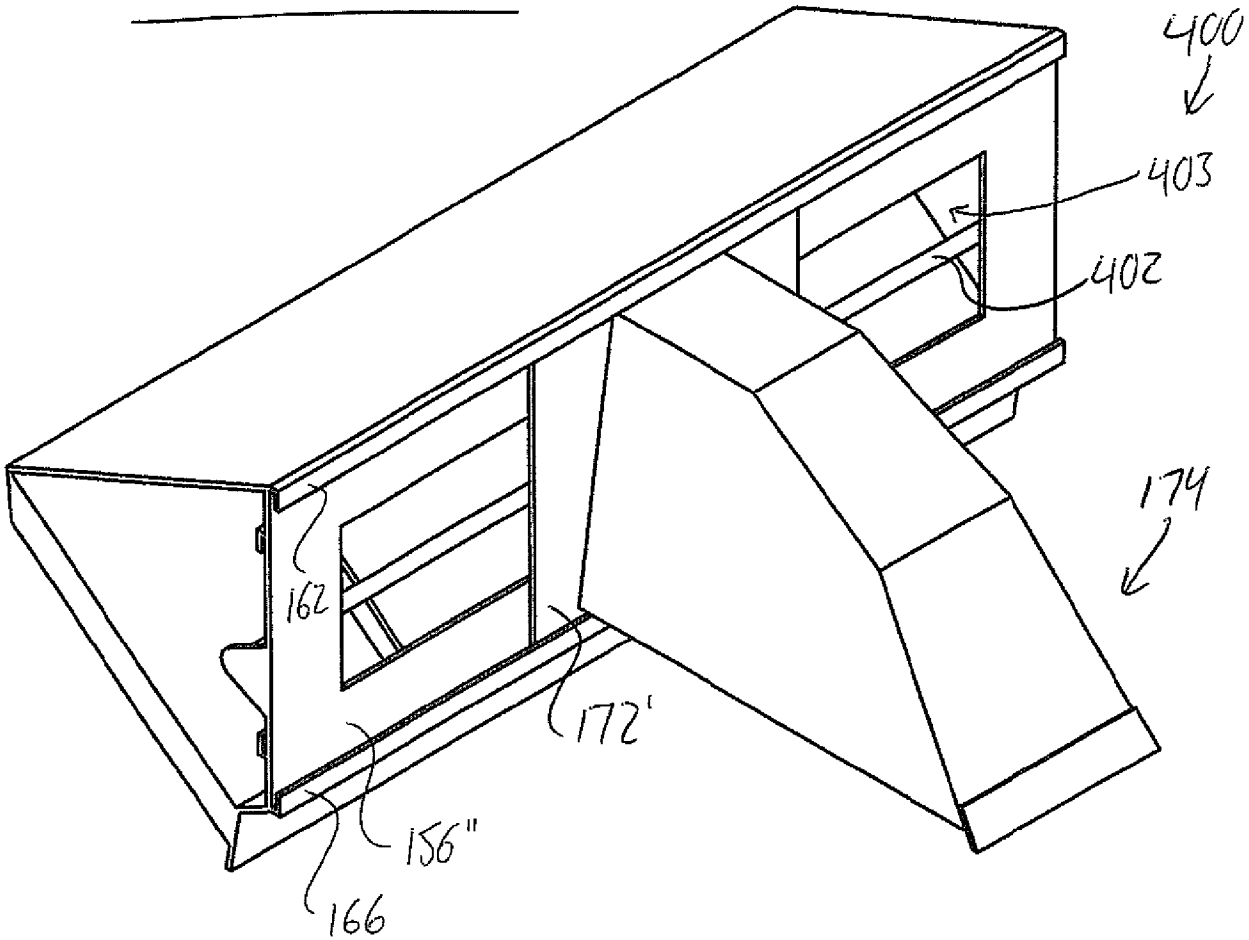
FIG. 17A is a front perspective view of a further variant of the motorized laterally adjustable implement system of FIG. 11, wherein a chain-based drive system is replaced with a gear-based drive system.
Figure 17B:
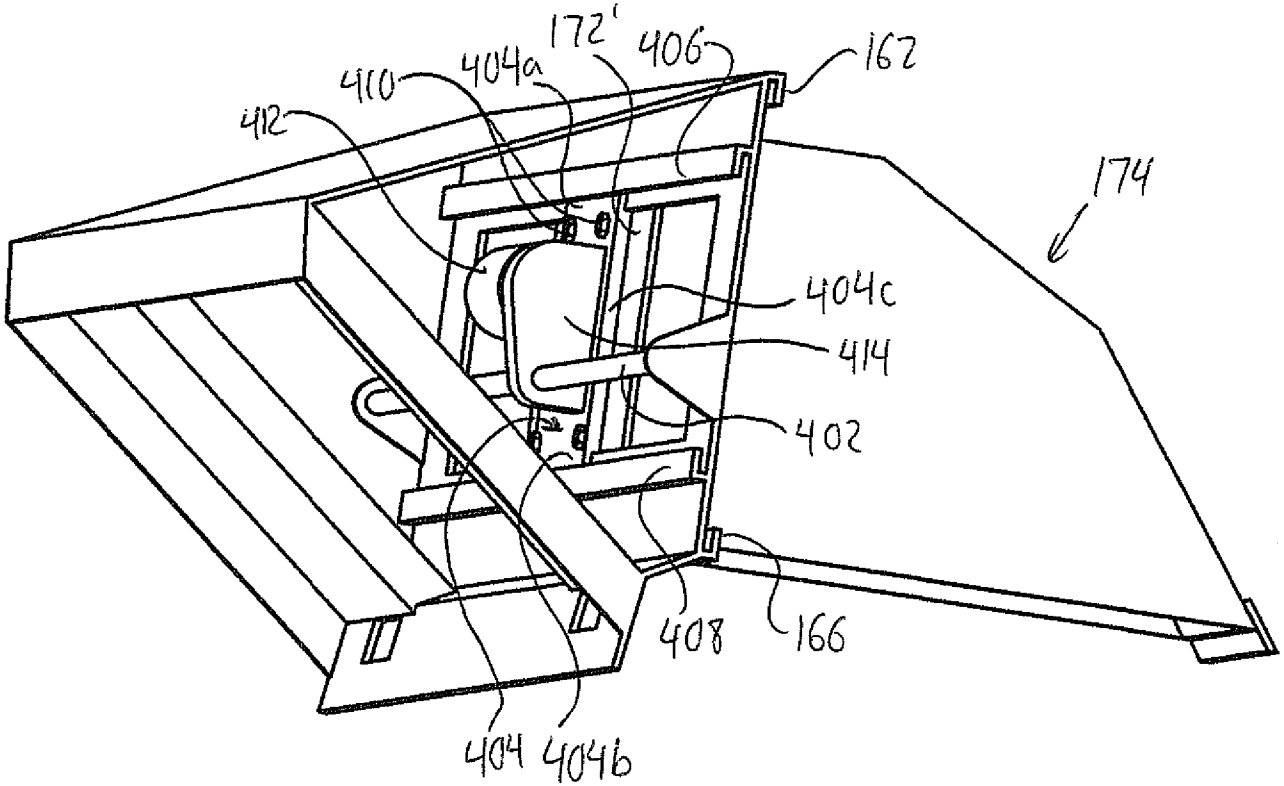
FIG. 17B is a side perspective view of the laterally adjustable implement system of FIG. 17A.
Figure 17C:
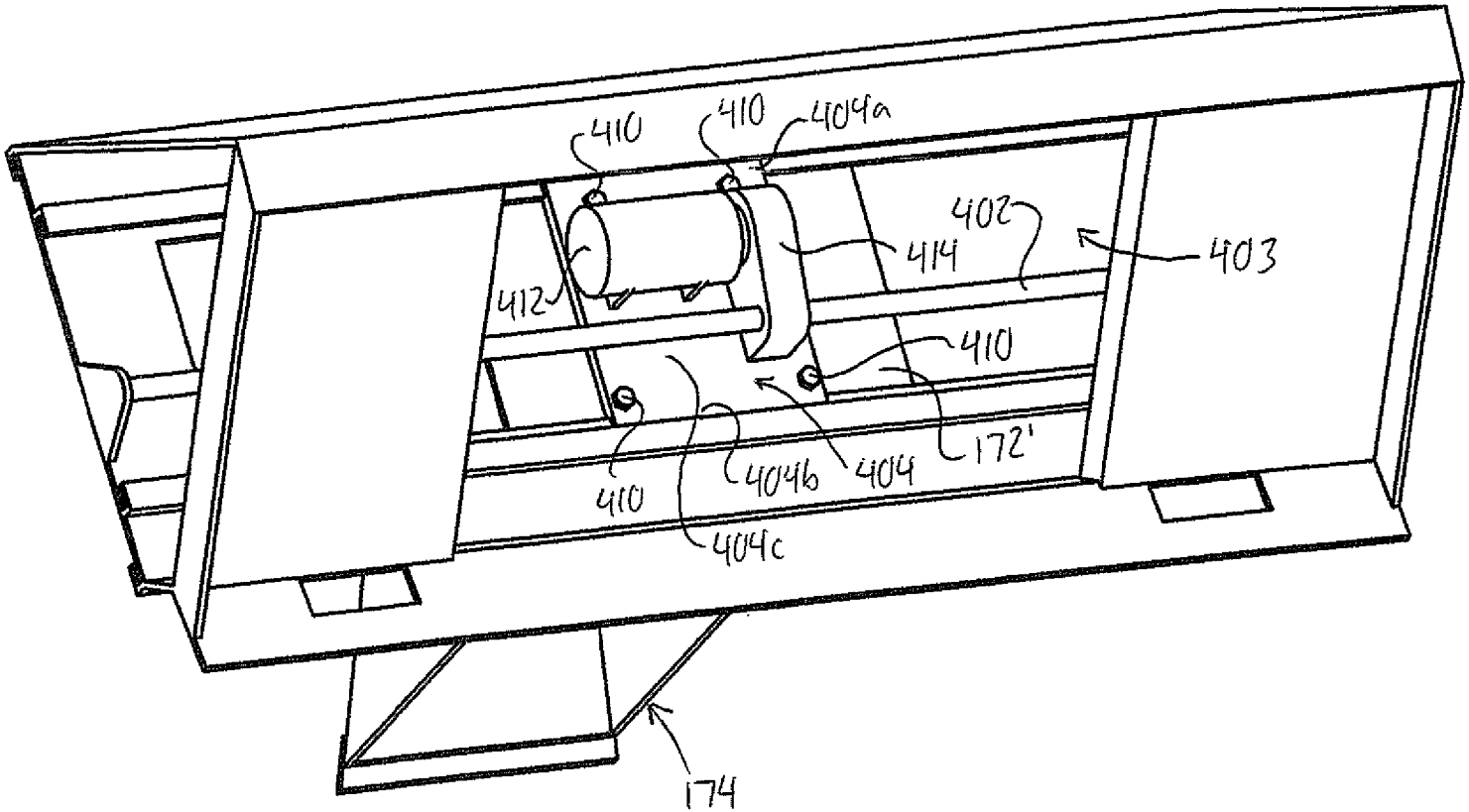
FIG. 17C is a rear perspective view of the laterally adjustable implement system of FIG. 17A.
Figure 17D:
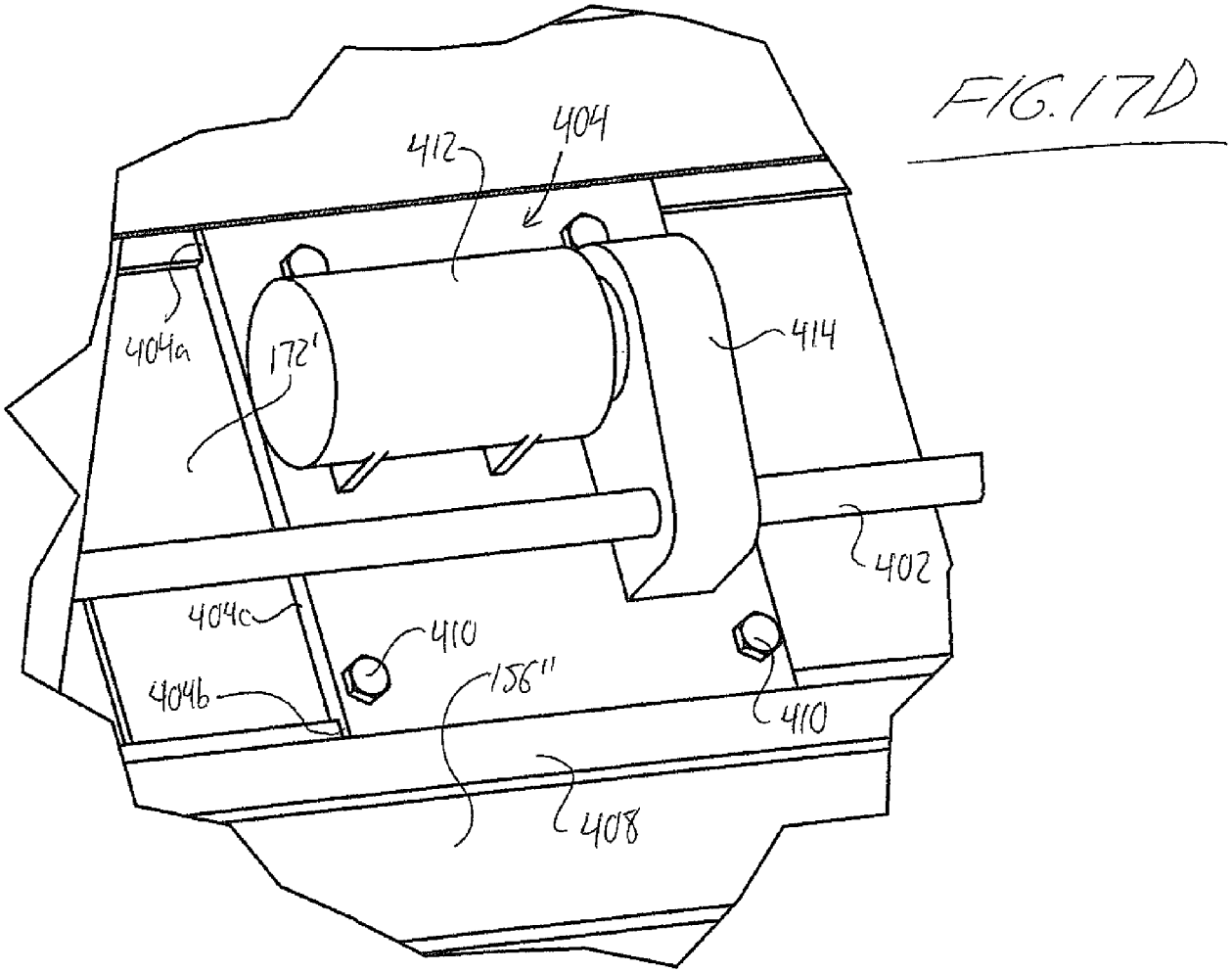
FIG. 17D is a partial close-up view of the laterally adjustable implement system of FIG. 17C.

FIG. 16C shows a close up view of the one of the brackets 302 of the adapter 300 of FIGS. 16A and 16B. The displacement mechanism 324 features a threaded rod 326 having one end thereof welded or otherwise fixed to the rectangular tubing 320 at the side thereof opposite the central span 314*a* of the channel member 314. The rod 326 runs parallel to the longitudinal axis of the tubing, extending past the open lower end of the tubing toward the gusset structure 316 that joins the front and rear ends of the bracket together at their lower extremities. In doing so, the rod 326 passes through a hole in a flange 328 that projects perpendicularly from the locking bar 322 at the end thereof opposite the tapered end 322*a*. A nut 330 is rotatably engaged on the threaded rod 326 from the free end thereof on the side of the locking bar flange 328 that faces away from the rectangular tubing 320. Still referring to FIG. 16C, to displace the locking bar from the retracted position shown therein, the nut 330 is driven in a tightening direction that threads the nut further onto the rod 326, toward the rectangular tubing 320. The displacement of the drive nut 330 along the rod axis likewise displaces the locking bar 322 further through the rectangular tubing into the extended position shown at the top of FIGS. 16A and 16B due to the contact of the nut against the face of the locking bar flange 328. To retract the tapered end 322*a* of the locking bar back into the tubing, the nut is simply rotated in the opposite direction, allowing the locking bar to automatically retract under gravitational action. A respective spring or other elastic member may be included to aid in retraction of each locking bar.

The front end of the adapter 300 is thus adapted to mate with quick attach units of the type mentioned above with regard to FIG. 3B, where locking pins or bars are arranged to slide into and out of extended positions engaging downwardly through the holes 308 in the bottom plate 306 of the adapter's front end. The locking bars 322 at the front end of the adapter unit 300 can then be used in a similar manner to engage upwardly through holes at the mounting end of an existing bucket of the type compatible with the quick attach units of the working machine, but with the bucket in an inverted orientation relative to that in which it would normally be attached directly to the working machine. The tapered ends 322*a* of the locking bars 322 minimize the potential for jamming of the locking bars while attempting to extend the same through the corresponding locking holes in the bucket or other implement.

By not having side walls at the inner sides of the base plates 304, and by featuring holes 308 of elongated shape for receipt of the locking pins or bars of the working machine's quick attach units, the adapter 300 can accommodate quick attach units of varying width and varying pin/bar sizes/positions. As an alternative to elongated holes 308, the adapter may alternatively accommodate different quick attach locking pin/bar positions by featuring a series of holes set apart across the width of the adapter according to known quick attach specifications. Keeping the triangular shape of the adapter frame open at both sides of each bracket maximizes the available space for accessing the locking bar displacement mechanism to achieve a securely locked attachment of the bucket or other implement to the adapter. The illustrated adapter uses angle-iron members in its frame structure, for example at the braces 318 thereof, but may employ other frame member types, for example rectangular tubing. In addition to the two cross-members provided at the rear end of the adapter 300 by the top and bottom plates 312, 306 that engage the quick attach, units of the working machine, an additional one or more cross-members may be added at the front of the machine between the upper ends of the rear channel members 314 for improved structural rigidity of the overall adapter frame.

Turning to FIG. 17, a further variant of the laterally adjustable implement system of FIG. 11 is illustrated, where the chain driven lateral adjustment mechanism is replaced by an alternative drive type. FIG. 17 also shows the system 400 in use with a bucket-type implement instead of the tooth implement of FIG. 11.

Instead of a chain wrapping around the side edges of a solid front plate of the frame, the variant of FIG. 17 features a threaded shaft 402 mounted inside the frame behind the front plate 156" to span across a rectangular opening 403 spanning a substantial width of the front plate 156". The base plate 172' of the bucket implement rides in the channels 162, 166 on the front side of the front plate 156" as in FIG. 11, but is also fastened to a motor-carrying plate 404 that rides in another pair of right-angle channel members 406, 408 that are fixed to a rear face of the front plate to similarly provide a track along which the motor-carrying plate 404 can slide transversely across the implement frame. The illustrated motor plate 404 has a stepped thickness, with a reduced rabbet-like thickness at its top and bottom edges 404*a*, 404*b* so that a thicker central portion 404*c* of the motor plate 404 passes through the rectangular opening 403 from a flat rear face of the implement base plate 172' in order to position the thinner top and bottom edges of the motor plate 404 behind the front plate 156", where they engage into the rear channels 162, 166.

For releasable connection of the bucket to the motor plate 404, a set of through-holes are provided in the central portion of the motor plate, and align with threaded blind holes provided in the rear face of the bucket's base plate 172', whereby the bucket can be secured to the motor plate by threaded fasteners 410 engaged into the bucket's base plate through the holes in the motor plate. Other embodiments may employ other releasable attachment configurations between the bucket and motor plate, for example using through-holes in both units with nut and bolt combinations engaged together via these holes. However, the use of threaded holes in one of the two units may have the advantage of an easier mode of attachment, particularly when a single person is attempting to install the bucket or other implement, and cannot easily reach both the implement base plate in front of the frame and the motor plate inside the frame. The frame is preferably open at both ends for convenient access to the fasteners 410 of the motor plate 404.

A motor 412, which is preferably a hydraulic motor for operation by the existing hydraulic system of the working machine, is mounted on the rear face of the motor plate 404 inside the frame along with a gear box 414. The motor 412 drives the input gear of a gear train inside the gear box, the output gear of which is an internally threaded gear that is rotatably engaged on the threaded shaft 402. Operation of the motor 412 in one direction drives the output gear in a respective direction, causing the overall assembly of the gearbox 414, motor 412, motor plate 404 and implement 174 to convey itself along the longitudinal axis of the threaded shaft 402, thus displacing the implement in a respective transverse direction across the front face of the frame. Operating the motor in the reverse direction transversely conveys the assembly in the opposing direction. Accordingly, the lateral position of the implement across the frame can be adjusted through operation of the motor. The rear end of the frame is configured in the manner described for the embodiment of FIG. 16 for attachment of the frame of the laterally adjustable implement system to a known type of quick attach configuration for working machines.

The illustrated motor plate 404 has a width less than that of the base plate 172' of the implement 174 in order to maximize the lateral range of movement of the implement itself. That is, the implement 174 may be extended to a laterally outward position in which the respective side edge of its base plate 172' resides outwardly past the respective end of the rectangular window opening 403 in the front plate 156" of the frame.

Figure 18A:
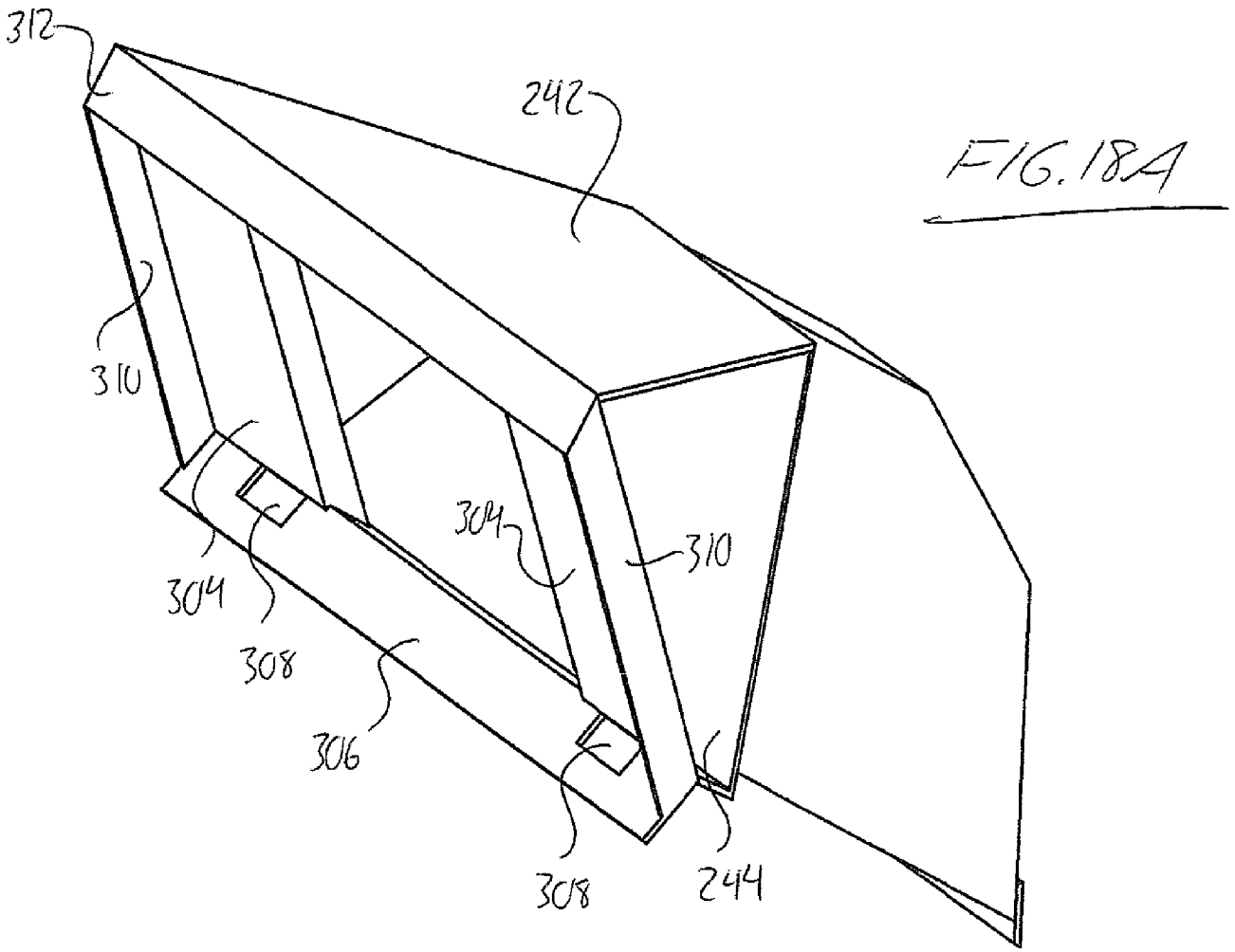
FIG. 18A is a rear perspective view of a variant of the bucket attachment of FIG. 13, whereby the brackets are compatible with a quick attach system of the type shown in FIG. 3B.
Figure 18B:
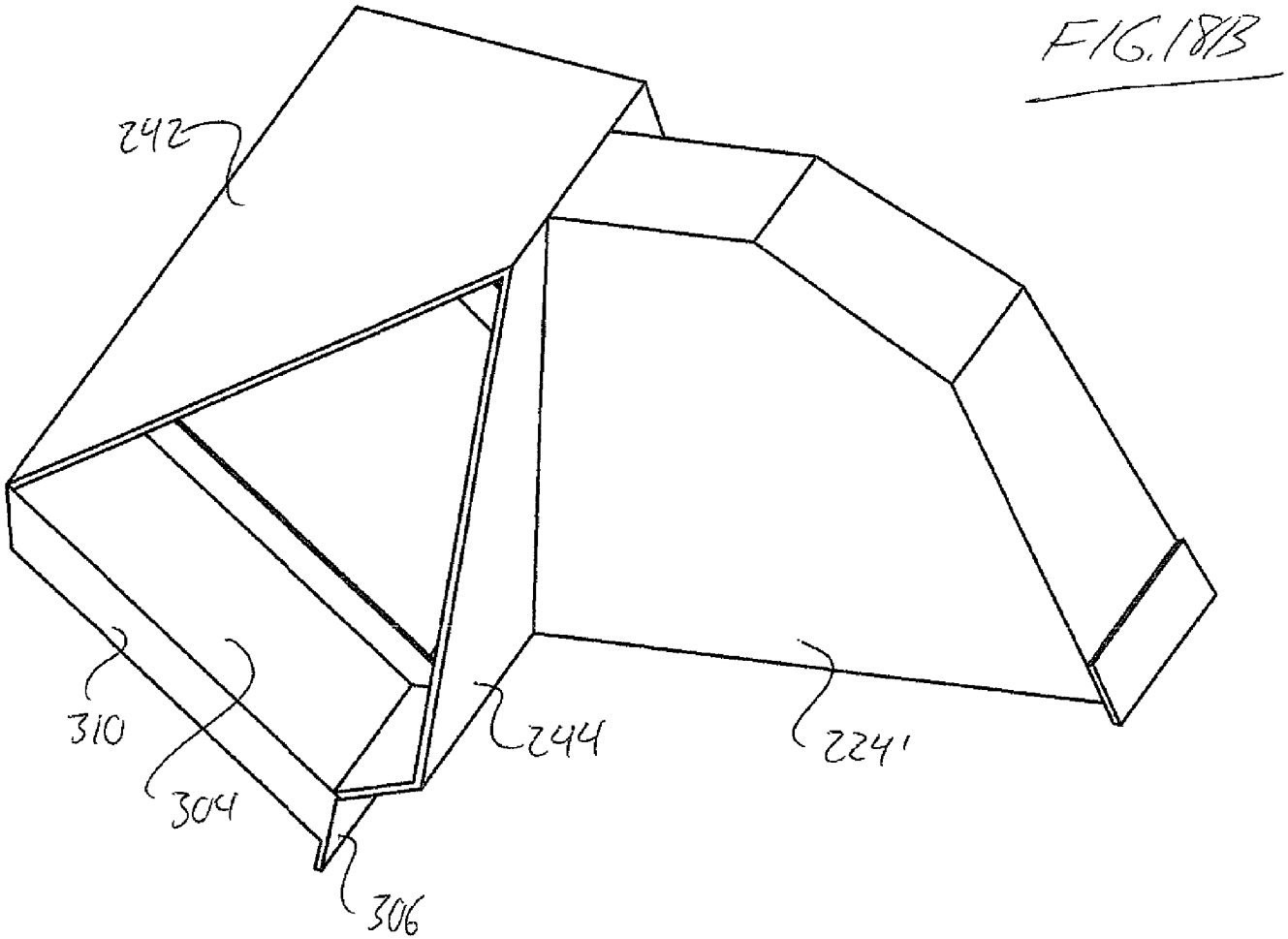
FIG. 18B is a side perspective view of the bucket attachment of FIG. 18A.
Figure 18C:
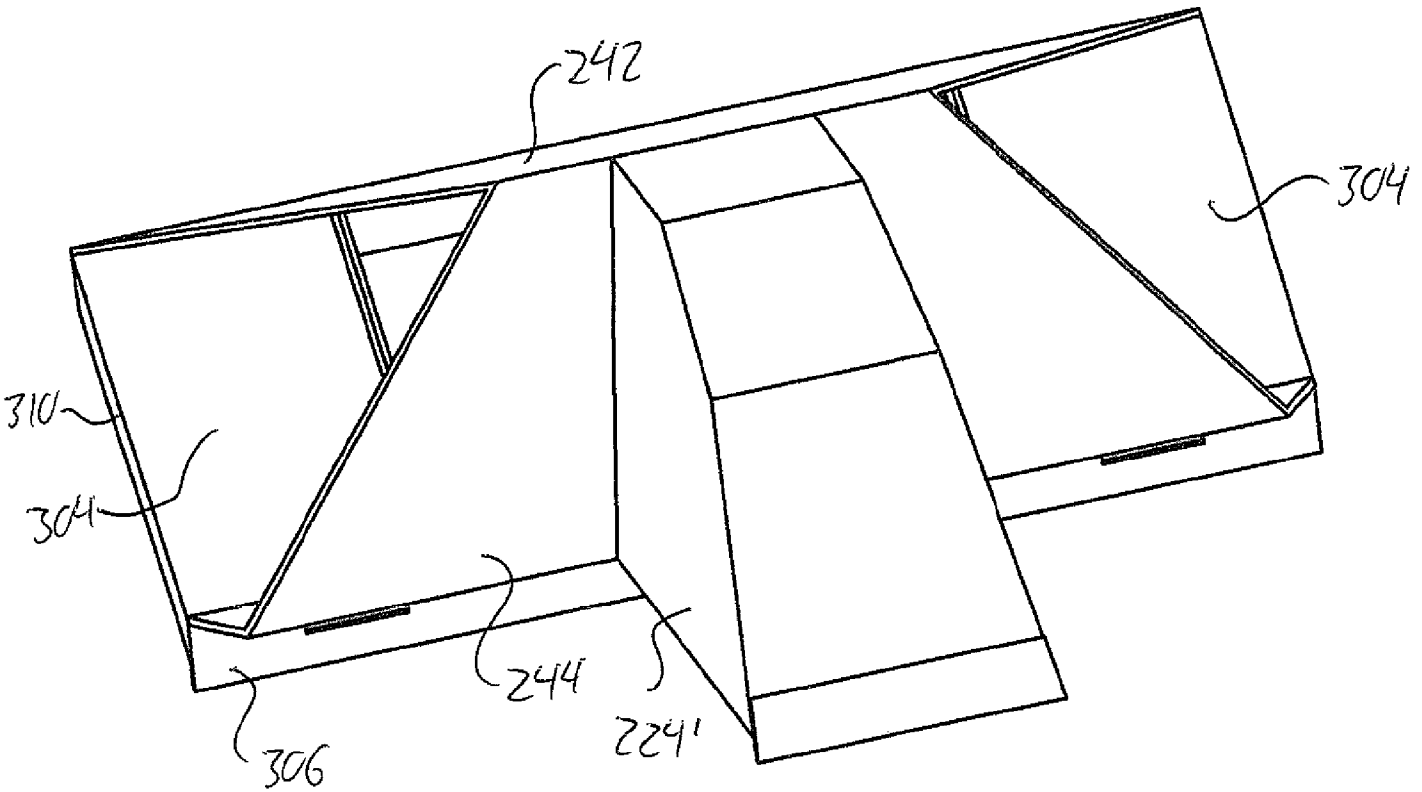
FIG. 18C is a front perspective view of the bucket attachment of FIG. 18A.

FIG. 18 shows a variant of the bucket of FIG. 13, but with the solid rear wall of the frame or box beam having been replaced with the rear-end structure described above in relation to the adapter 300 of FIG. 16. The rear of frame thus features two respective base plates 304 at opposite sides of the frame, a bottom plate 306 defining a lower cross-member joining the base plates together across the frame at the lower edges of these base plates 304 and featuring elongated holes 308 for receipt of locking pins or bars of a quick attach configuration on the lift arms of a working machine, and a top plate 312 forming an upper cross-member that joins the base plates at their top edges and hooks over the top of the attachment configuration on the working machine to hang the frame on the lift arms of the machine. As in FIG. 16, the bottom plate is at a slightly obtuse angle relative to the rear face of the base plates to minimize interference with insertion of the amle attachment units of the machine's lift arms into the female cavity formed at the rear end of the bucket frame by the space bound by the top and bottom plate and side walls of the frame's rear end configuration. The FIG. 18 bucket also varies from that of FIG. 13 in that the bucket has a tapered design, in which the side walls 224' of the bucket diverge away from one another moving toward the bucket opening to encourage the release of material from the bucket during a dumping operation.

It will be appreciated that the above embodiments have been described in terms of the connection features of select conventional implement attachment configurations, and that other embodiments may employ connection features other than the shown and described arrangement of projection/slot and pin/hole engagement while still arranging this features in a similar relative manner to facilitate mounting of bucket or other implement in an inverted manner on a front end loader arrangement at a position placing the rear end of the bucket opening in close proximity to the pivotal connection to the lift arms of the front-end loader machine to enable an improved scooping action over the aforementioned boom-carried inverted buckets of the prior art without requiring any bucket-tilting actuator beyond the existing standard equipment of the working machine.

The present invention, in inverting a large bucket on a loader doesn't presume to replace the forward-facing orientation as the most generally preferred mode. But in that forward mode, even in a skid steer, the operator sees only the backside of the bucket, which blocks any view of the leading cutting edge, or the entry angle being applied, or the depth of the plunge, or the amount of material gathered in the bucket. The operator relies on trial and error, experience, and 'feel'. In a tractor-type as opposed to a skid-steer, the operator's view of the bucket is also much blocked by the tractor's engine compartment, lift boom assembly, and front tires. Often only small portions of each sides of the bucket's rear wall are visible when lowered. A prime feature in use of the present invention, with the bucket rearward facing and the machine operating in reverse, is that the operator can now see what the tool is doing and can therefore best manipulate his controls to have the bucket accurately carve, capture etc.

Also the forward thrust exerted of a standard forward facing operation can put damaging stress on structures in front of and beyond it, since the filling of the bucket relies on the resistance offered by the material or structures such as fences, walls, trees just beyond it. Instead, in reaching forward, capturing and drawing the material towards itself in rearward mode, the machine leaves those structures unaffected.

So the present invention is not meant to replace conventional forward facing bucket use, but to expand the versatility of the bucket on a loader. To best achieve this, the disclosed devices by design are intended primarily for shallow excavation operations. The disclosed devices, even in the smaller bucket versions of FIGS. 7-14, is not intended to compete for or emulate, is the workings of a backhoe, i.e. deep-digging and trenching functionality.

Previous art, such as Lalonde and Rubio, target a trench-dig function for a loader, with the small fixed digging bucket mounted substantially away from the loader pivot point, thwarting its chance of performing the cupping/scooping action of the present invention.

In short, the present invention, even in the small bucket embodiments, performs a different service, and is functionally distinct. Except for that of FIG. 4A, the embodiments of the present invention intend to deliver the optimal relocation of the rotational field of the implement/bucket further around the pivot point, when exercising the inverted option. The embodiment in FIG. 4A may be sufficient for use where such rotational ability is already achievable by a loader's own specially improved bucket articulation apparatus.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A working machine comprising:

a pair of rigid lift arms pivotally carried on a frame of the working machine adjacent a first end of said lift arms;

a lift arm actuation mechanism operable to pivot said pair of rigid lift arms relative to the frame;

at least one bucket actuator carried on said pair of rigid lift arms;

a bucket connection device having an inversed mode actuator connector coupled to an output of each bucket actuator and a pivotal inversed mode arm connector coupled to the lift arms adjacent a second end of said lift arms;

a bucket having an end wall, a tip distal to the end wall, and an opening spanning from the tip to an end of the opening adjacent the end wall, the end wall of the bucket being carried by the bucket connection device in a manner such that the end of the opening adjacent the end wall is positioned adjacent the inversed mode pivotal arm connector; and a control system operable to control the lift arm actuation mechanism for raising and lowering the second end of said lift arms and control the at least one bucket actuator to pivot the bucket connector and the bucket carried thereon;

wherein the bucket connection device comprises a box beam having a front plate to which the bucket is attached, a rear plate on which inversed mode actuator connector and the inversed mode arm connector are carried, and a top plate that interconnects the front and rear plates to define an upper end of the box beam that is wider in a in a vertical cross-sectional plane of the box beam than a lower end of the box beam;

wherein the top and front plates of the box beam each grow narrow toward one another.

2. The working machine of claim 1 wherein the bucket connection device has tapered shape in a vertical cross-sectional plane that is narrower at a lower end thereof than at a wider upper end thereof.

3. The working machine of claim 1 wherein the end wall of the bucket is irremovably attached to the connection device.

4. The working machine of claim 1 wherein the bucket connection device comprises a normal mode actuator connector disposed adjacent the inversed mode pivotal arm connector and a normal mode pivotal arm connector disposed adjacent the inversed mode actuator connector, the lifting arms and the output of each bucket actuator being detachable from the inversed mode connectors and reattachable to the bucket connector at the normal mode connectors with the bucket connector inverted in order to invert an orientation of the bucket on the lift arms.

5. The working machine of claim 4 wherein the normal mode connectors are in a different plane than the inversed mode connectors.

6. The working machine of claim 4 wherein a plane of the normal mode connectors is adjustable relative to a plane of the inversed mode connectors.

7. The working machine of claim 1 wherein the inversed mode actuator connector comprises a first series of selectable connection points at which connection of the bucket connection device to the output of the bucket actuator may be made.

8. The working machine of claim 7 wherein the inversed mode pivotal arm connector comprises a second series of user-selectable connection points at which the bucket connection device and the lift arms are connectable.

9. The working machine of claim 7 wherein each selectable connection point comprises a pin-hole through which pinned connection of the bucket connection device is achievable.

10. The working machine of claim 1 wherein the inversed mode pivotal arm connector comprises a series of user-selectable connection points at which the bucket connection device and the lift arms are connectable.

11. The working machine of claim 1 comprising a quick coupling device secured to the bucket actuator at the output thereof and to the lift arms adjacent the second end thereof, the inversed mode actuator connector and the inversed mode pivotal arm connector being configured to couple of the bucket actuator and the lift arms respectively via the quick coupling device.

12. The working machine of claim 11 wherein coupling between the quick coupling device and the bucket connection device is achieved by engagement of a projection into a slot between the quick coupling device and the bucket connection device and engagement of at least one pin through at least one aligned hole in at least one of the quick coupling device and the bucket connection device.

13. The working machine of claim 12 wherein engagement of the projection and the slot engage is achieved at the inversed mode actuator connector and engagement of the pin through the aligned holes is achieved at the inversed mode lift arm connector.

14. The working machine of claim 11 wherein the bucket connection device is configured to removably couple to the bucket via quick connect features of a same type as the quick coupling device secured to the bucket actuator and the lift arms.

15. The working machine of claim 1 wherein the bucket connection device is arranged for detachable coupling to the bucket.

16. The working machine of claim 15 wherein bucket connection device is arranged for detachable coupling to the bucket via connection features of a same type as found in the connection of the lift arms and the bucket actuator to the bucket connection device.

17. The working machine of claim 1 having a tapered shape between the inversed mode connectors and the bucket, the tapered shape narrowing toward the opening of the bucket.

* * * * *